US011421898B2

(12) United States Patent
Shultz et al.

(10) Patent No.: US 11,421,898 B2
(45) Date of Patent: Aug. 23, 2022

(54) COIL LOCATOR FOR AN OUTDOOR UNIT OF A CLIMATE CONTROL SYSTEM

(71) Applicant: Trane International Inc., Davidson, NC (US)

(72) Inventors: Gary Shultz, Tyler, TX (US); Bryan Hawkins, Tyler, TX (US); Eric Klauer, Tyler, TX (US); Jeff Cool, Tyler, TX (US)

(73) Assignee: Trane International Inc., Davidson, NC (US)

( * ) Notice: Subject to any disclaimer, the term of this patent is extended or adjusted under 35 U.S.C. 154(b) by 144 days.

(21) Appl. No.: 16/898,274

(22) Filed: Jun. 10, 2020

(65) Prior Publication Data

US 2021/0388997 A1 Dec. 16, 2021

(51) Int. Cl.

| | |
|---|---|
| ***F25D 21/14*** | (2006.01) |
| ***F24F 1/56*** | (2011.01) |
| ***F24F 1/50*** | (2011.01) |
| *F24F 1/38* | (2011.01) |
| *F24F 13/20* | (2006.01) |
| *F24F 1/16* | (2011.01) |

(52) U.S. Cl.

CPC ..... *F24F 1/56* (2013.01); *F24F 1/50* (2013.01); *F24F 1/16* (2013.01); *F24F 1/38* (2013.01); *F24F 2013/202* (2013.01); *F24F 2013/205* (2013.01); *F24F 2013/207* (2013.01)

(58) Field of Classification Search

CPC ..... F24F 1/56; F24F 1/50; F24F 1/16; F24F 1/38; F24F 1/36; F24F 13/30; F24F 2013/202; F24F 2013/205; F24F 2013/207

USPC ..... 62/285

See application file for complete search history.

(56) References Cited

U.S. PATENT DOCUMENTS

| | | | | |
|---|---|---|---|---|
| 3,904,158 | A | 9/1975 | Michael | |
| 4,748,827 | A | 6/1988 | Chang | |
| 6,390,180 | B1 | 5/2002 | Olsen | |
| 7,117,926 | B2 | 10/2006 | Mori et al. | |
| 7,266,956 | B2 | 9/2007 | Norrell et al. | |
| 7,708,052 | B2 | 5/2010 | Leman et al. | |
| 10,215,507 | B2 * | 2/2019 | Mastroianni | F28D 1/047 |
| 10,451,363 | B2 | 10/2019 | Eskew et al. | |
| 2019/0137118 | A1 | 5/2019 | Otsuka et al. | |

FOREIGN PATENT DOCUMENTS

JP 2016084995 A 5/2016

* cited by examiner

*Primary Examiner* — Len Tran
*Assistant Examiner* — Kamran Tavakoldavani
(74) *Attorney, Agent, or Firm* — Womble Bond Dickinson (US) LLP

(57) ABSTRACT

Outdoor units for climate control systems and related methods are disclosed. In an embodiment, the outdoor unit includes a base pan including an upper surface, a lower surface opposite the upper surface, and at least one receptacle, wherein the at least one receptacle comprises an aperture. Additionally, the outdoor unit includes at least one coil locator coupled to the at least one receptacle of the base pan wherein the at least one coil locator comprises a tongue which extends through the aperture and a pair of horizontally spaced feet separate and distinct from the tongue and which are received in the aperture. Further, the outdoor unit includes a heat exchanger coil, and an outdoor fan configured to produce an airflow across the heat exchanger coil.

20 Claims, 14 Drawing Sheets

COIL LOCATOR FOR AN OUTDOOR UNIT OF A CLIMATE CONTROL SYSTEM

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

Heat exchangers are used in a variety of commercial and residential settings for a variety of purposes. For example, a climate control system for circulating a refrigerant through a refrigerant loop so as to exchange heat between an indoor space (e.g., a house, office, commercial store, etc.) and an outdoor ambient environment surrounding the indoor space may include an outdoor unit positioned in the outdoor ambient environment. The outdoor unit of the climate control system may comprise a heat exchanger coil. The heat exchanger coil of the outdoor unit may transfer heat between refrigerant flowing through the heat exchanger coil and an airflow passing over the heat exchanger coil. In some applications, the heat exchanger coil may be physically supported by a base pan of the outdoor unit.

BRIEF SUMMARY

Some embodiments disclosed herein are directed to an outdoor unit of a climate control system. In an embodiment, the outdoor unit includes a base pan comprising an upper surface, a lower surface opposite the upper surface, and at least one receptacle, wherein the at least one receptacle comprises an aperture extending entirely through the base pan from the upper surface to the lower surface. Additionally, the outdoor unit includes at least one coil locator coupled to the at least one receptacle of the base pan wherein the at least one coil locator comprises a tongue which extends through the aperture, and a pair of horizontally spaced feet separate and distinct from the tongue and which are received in the aperture, wherein the pair of feet are aligned along a horizontal axis which extends through the pair of feet and wherein the pair of feet restrict the at least one coil locator from pivoting about a pivot axis extending vertically and orthogonal to the horizontal axis. Further, the outdoor unit includes a heat exchanger coil having an upper end and a lower end opposite the upper end, and wherein the lower end of the heat exchanger coil is positioned on the at least one coil locator, and a fan configured to produce an airflow across the heat exchanger coil.

Other embodiments disclosed herein are directed to an outdoor unit of a climate control system that includes a base pan comprising an upper surface, a lower surface opposite the upper surface, and at least one receptacle, wherein the at least one receptacle comprises an aperture extending entirely through the base pan from the upper surface to the lower surface. In addition, the outdoor unit includes at least one coil locator coupled with the receptacle of the base pan, wherein the at least one coil locator comprises a pair of horizontally spaced feet and a tongue separate and distinct from the pair of feet, wherein the tongue extends through the aperture and beneath the lower surface of the base pan whereby a vertical axis extending orthogonal to the lower surface of the base pan and intersects both the lower surface and the tongue. Further, the outdoor unit includes a heat exchanger coil having an upper end and a lower end opposite the upper end, and wherein the lower end of the heat exchanger coil is positioned on the at least one coil locator, and a fan configured to produce an airflow across the heat exchanger coil.

Still other embodiments disclosed herein are directed to a method for assembling an outdoor unit of a climate control system. In an embodiment, the method includes contacting an upper surface of a base ban of the outdoor unit with a support surface of a coil locator of the outdoor unit, wherein the coil locator comprises a pair of horizontally spaced feet and a tongue separate and distinct from the pair of feet. In addition, the method includes inserting the tongue of the coil locator through an aperture of a receptacle of the base pan and beneath a lower surface of the base pan whereby a vertical axis extending parallel to the lower surface intersects both the lower surface and the tongue. Further, the method includes lowering a heat exchanger coil onto the coil locator.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various exemplary embodiments, reference will now be made to the accompanying drawings in which.

DETAILED DESCRIPTION

Figure 1:
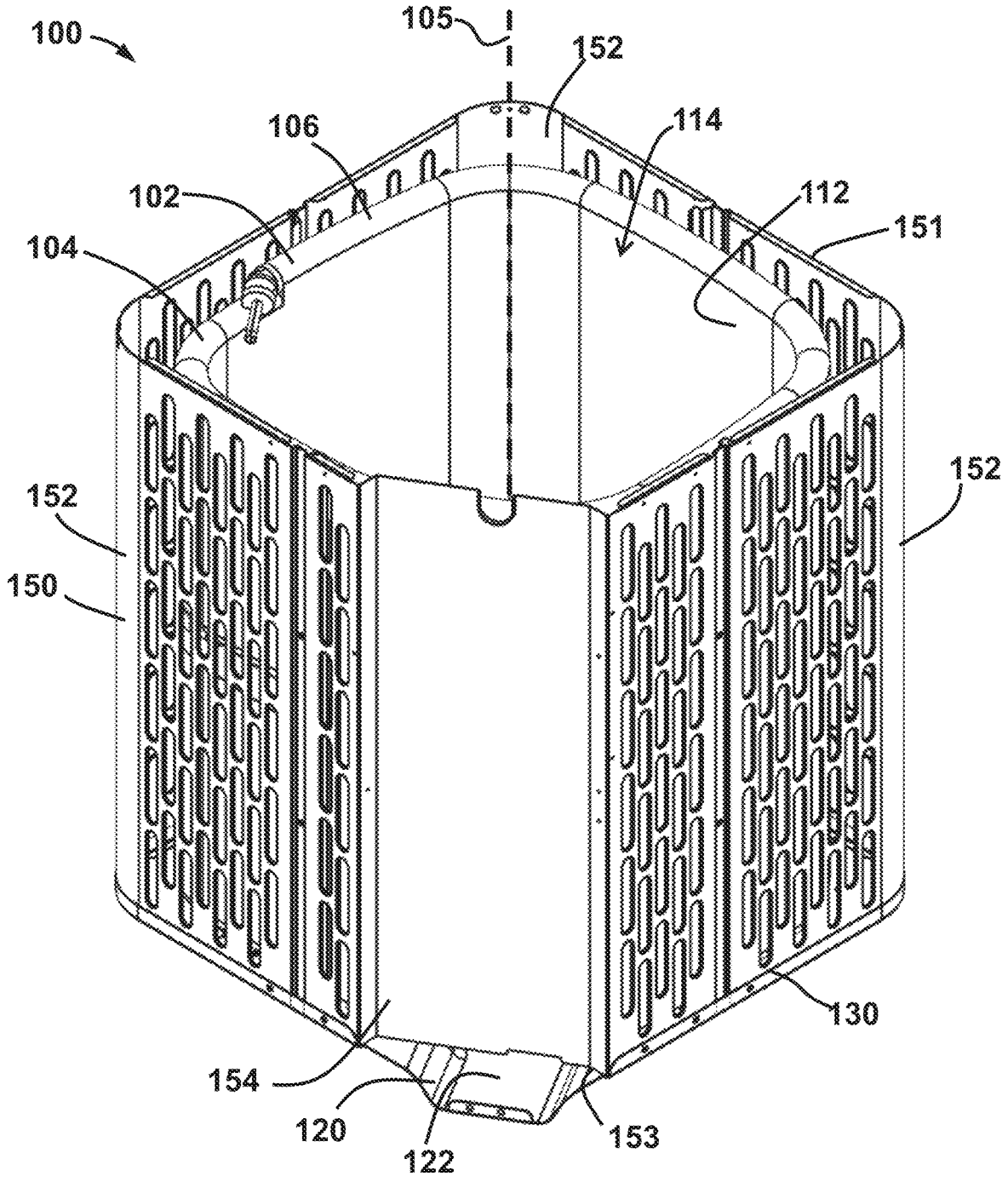
FIGS. 1, 2 are perspective views of an outdoor unit according to some embodiments.

The following discussion is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis. Further, when used herein (including in the claims), the words "about," "generally," "substantially," "approximately," and the like mean within a range of plus or minus 10%.

As used herein, a "climate control system" refers to any system, component, or collection of components that is used to circulate a fluid (e.g., a refrigerant) so as to alter or affect the climate conditions (e.g., temperature, relative humidity, etc.) within a defined space (e.g., an interior space of a home, office, retail store, etc.). The term "climate control system" specifically includes (but is not limited to) air conditioning systems, heat pump systems, dehumidification systems, heating ventilation and air-conditioning (HVAC) systems, etc.

As described above, an outdoor unit of a climate control system may include a heat exchanger coil physically supported by a base pan of the outdoor unit. The outdoor unit may comprise a fan generally configured to produce an airflow over a plurality of tubes of the heat exchanger coil whereby heat is transferred between the airflow and refrigerant circulating through the plurality of tubes.

During assembly of the outdoor unit, the heat exchanger coil may be lowered onto the base pan such that a lower end of the heat exchanger coil is positioned near the base pan. Unless positively located by a coil locator of the outdoor unit, the heat exchanger coil of the conventional outdoor unit may be permitted to move horizontally or slide upon the base pan, such as when the outdoor unit is in transport, which may damage the heat exchanger coil. Damage to the heat exchanger coil may have a negative impact on performance because deformation of the heat exchanger coil can impact the ability for the heat exchanger coil to transfer thermal energy during operation of the outdoor unit.

Additionally, in some applications, water within the air of the ambient environment may condense during operation of the outdoor unit. Water condensed during the operation of the outdoor unit may collect or pool on surfaces of the base pan.

Accordingly, embodiments disclosed herein include coil locators for positively locating a heat exchanger coil of an outdoor unit relative to a base pan of the outdoor unit whereby relative horizontal movement between the heat exchanger coil and the base pan is prevented. Particularly, coil locators disclosed herein are configured to lock to the base pan using a tongue and/or one or more feet of the coil locator to prevent relative movement between the coil locator and the base pan. By preventing relative movement between the coil locator and the base pan, relative movement between the heat exchanger coil (located by the coil locators) and the base pan may be prevented. Additionally, coil locators disclosed herein also ensure the lower end of the heat exchanger coil is elevated from the base pan whereby the heat exchanger coil is not exposed to water collected on surfaces of the base pan.

Figure 2:
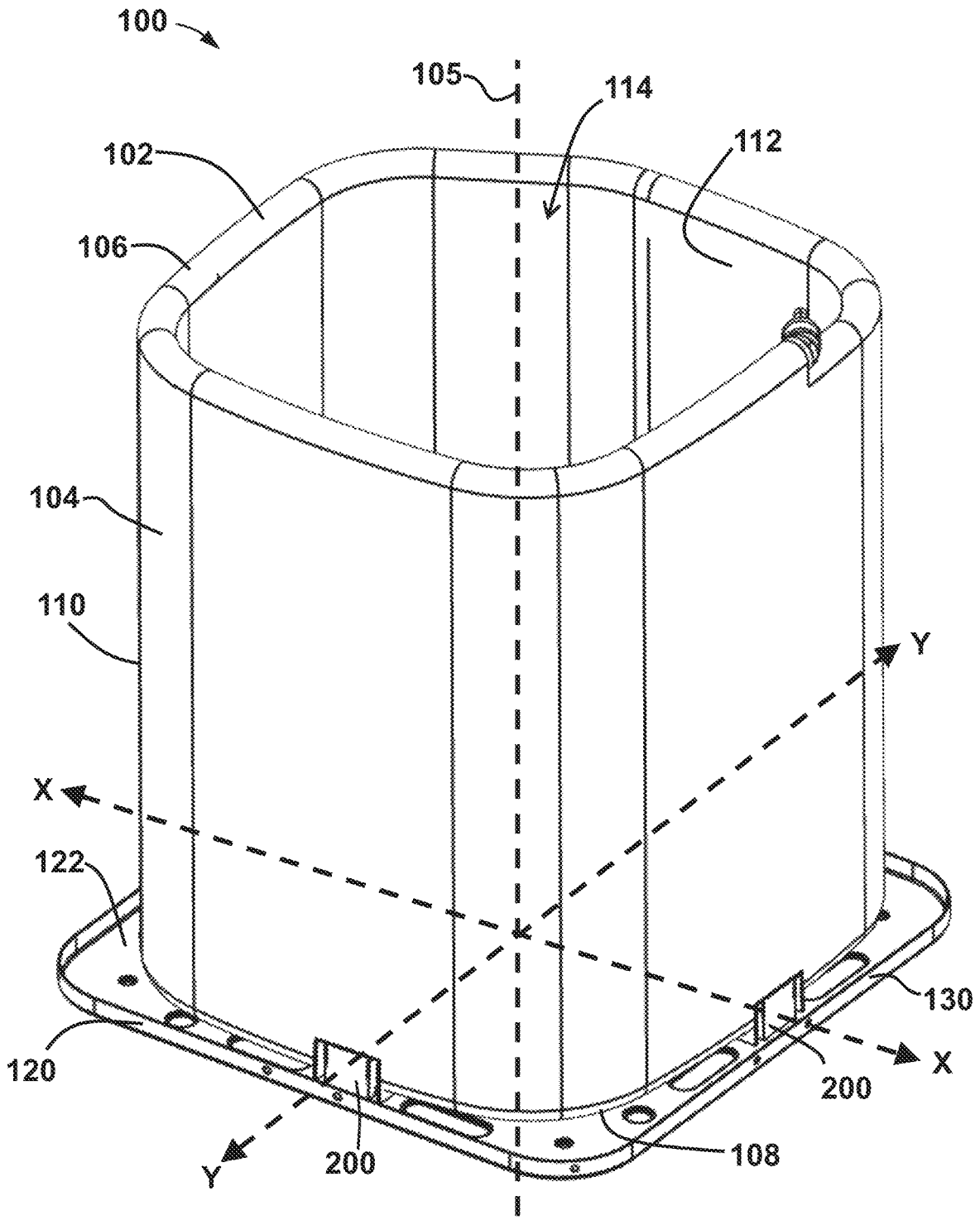
Figure 3:
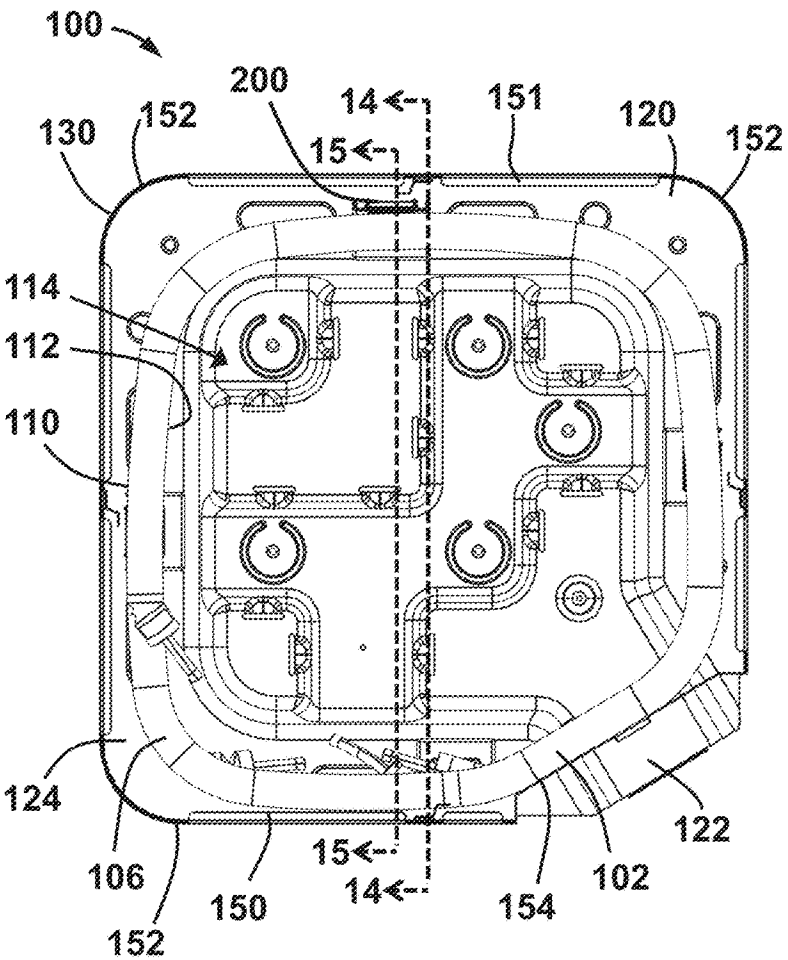
FIG. 3 is a top view of the outdoor unit of FIGS. 1, 2.

Referring now to FIGS. 1-3, an outdoor unit 100 for a climate control system according to some embodiments is shown. In this embodiment, outdoor unit 100 has a longitudinal axis 105 and generally includes an outdoor heat exchanger coil 102, a base pan 120, a protective shroud 150, and a plurality of coil locators 200. Outdoor unit 100 may include additional components not shown in FIGS. 1-3 in the interest of clarity, such as a fan for providing an airflow over heat exchanger coil 102. Additionally, in the interest of clarity, shroud 150 is not shown in FIG. 2.

The heat exchanger coil 102 of outdoor unit 100 may generally be configured to promote heat exchange between refrigerant carried within tubing 104 (not shown in detail in FIGS. 1-3) of the heat exchanger coil 102 and an airflow (e.g., generated by a fan of outdoor unit 100 not shown in FIGS. 1-3) that may contact the heat exchanger coil 102 but that is segregated from the refrigerant. Heat exchanger coil 102 may be formed generally from aluminum and may comprise a spine-fin coil where a plurality of spine-fins (not shown in FIGS. 1-3) extend radially outwards from the tubing 104 of heat exchanger coil 102. However, in other embodiments, heat exchanger coil 102 may comprise a plate-fin heat exchanger coil, a microchannel heat exchanger coil, or any other suitable type of heat exchanger coil.

In some embodiments, heat exchanger coil 102 has a central or longitudinal axis parallel with longitudinal axis 105, a longitudinal first or upper end 106, a longitudinal second or lower end 108 opposite upper end 106, a radially outer (relative to longitudinal axis 105) end 110, and a radially inner end 112 that forms a central passage or opening 114 of the heat exchanger coil 102 through which longitudinal axis 105 extends. As will be described further below, in some embodiments, heat exchanger coil 102 may include an inlet for receiving refrigerant from a compressor of a climate control system positioned in the central opening 114 of heat exchanger coil 102, and an outlet for conveying refrigerant from the heat exchanger coil 102 to an indoor unit of a climate control system comprising outdoor unit 100.

Figure 4:
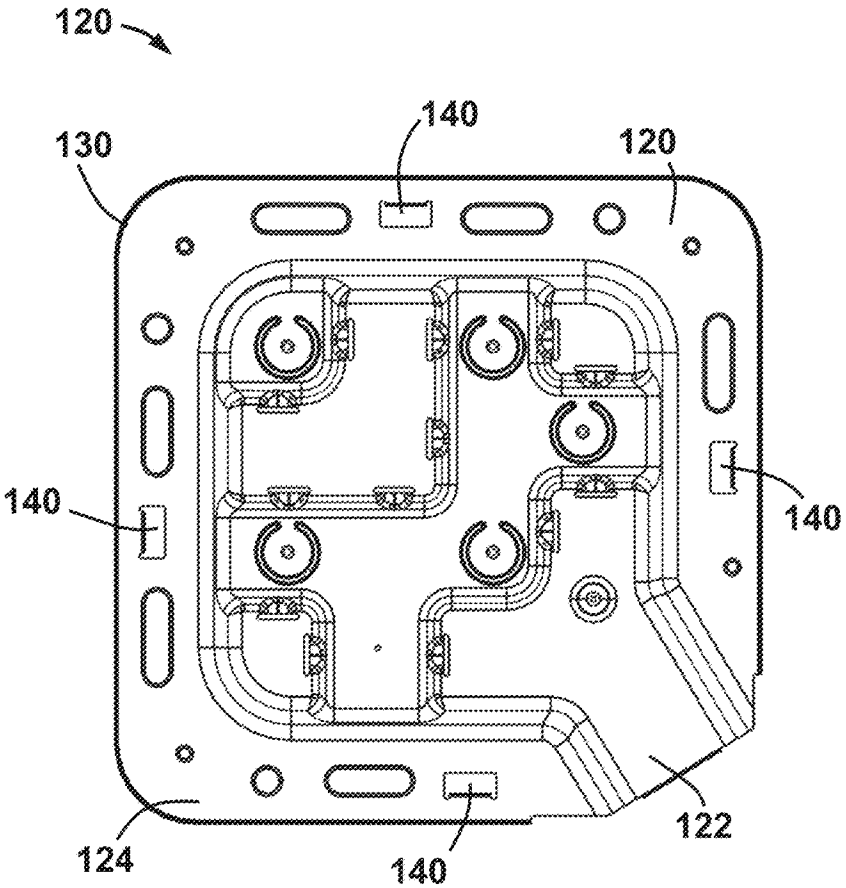
FIG. 4 is a top view of a base pan of the outdoor unit of FIGS. 1, 2 according to some embodiments.
Figure 6:
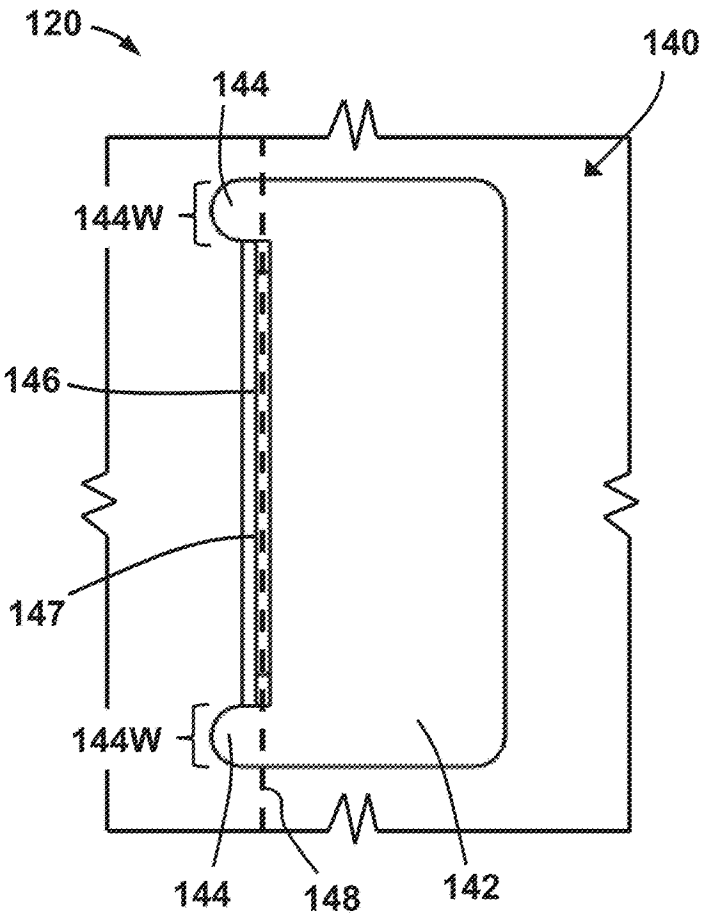
FIG. 6 is a top view of the coil locator receptacle of FIG. 5.
Figure 5:
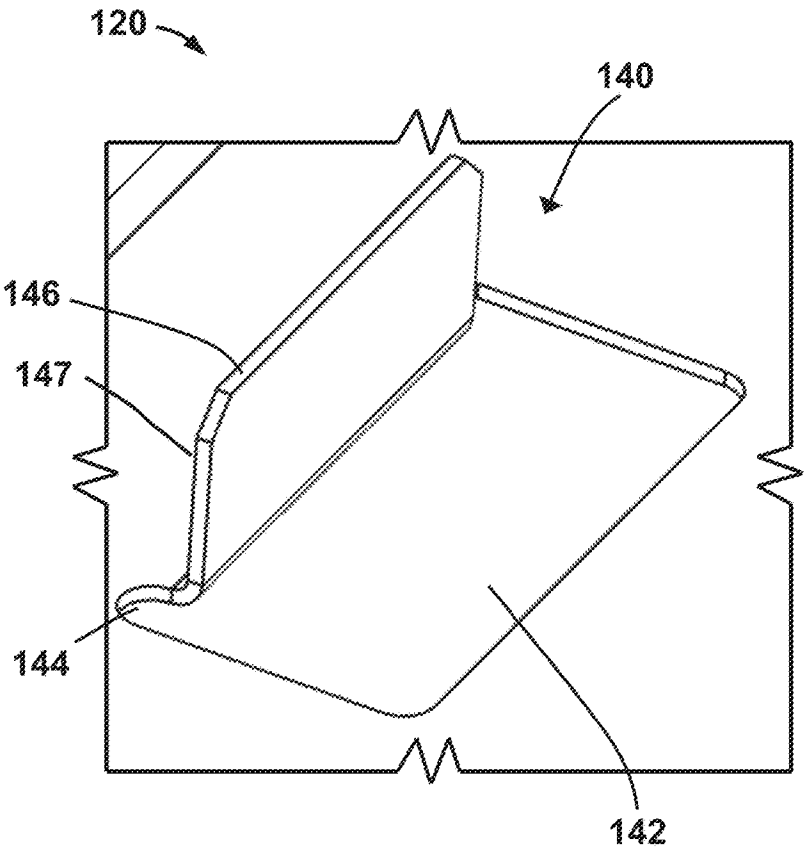
FIG. 5 is a perspective view of a coil locator receptacle of the base pan of FIG. 4 according to some embodiments.

Referring to FIGS. 4-6, detailed views of the base pan 120 of outdoor unit 100 are shown. The base pan 120 of outdoor unit 100 physically supports the other components of outdoor unit 100 including the heat exchanger coil 102 and protective shroud 150. In embodiments where outdoor unit 100 forms part of an outdoor unit of a climate control system, base pan 120 may also physically support, directly or indirectly, an outdoor fan and a compressor of the outdoor unit. In some embodiments, base pan 120 includes an upper surface 122 and an opposing lower surface 123 (shown in FIGS. 14, 15). Upper surface 122 of base pan 120 may face opposite the ground or surface upon which outdoor unit 100 is positioned following the installation of outdoor unit 100. Base pan 120 may also include an outer lip 130 extending about the longitudinal axis 105 of outdoor unit 100 along an outer perimeter of base pan 120.

The upper surface 122 of base pan 120 may comprise a generally planar coil support surface 124 extending circumferentially about the longitudinal axis 105 of outdoor unit 100. Additionally, coil support surface 124 may be positioned adjacent the outer perimeter of base pan 120 and may extend radially inwards (relative longitudinal axis 105) from outer lip 130. In some embodiments, the coil support surface 124 comprises a plurality of coil locator receptacles 140 spaced circumferentially about the longitudinal axis 105 of outdoor unit 100, each coil locator receptacle 140 being configured to matingly receive one of the plurality of coil locators 200 of outdoor unit 100. In the embodiment shown in FIGS. 4-6, base pan 120 includes four coil locator receptacles 140 spaced equidistantly (e.g., ninety degrees apart) about the longitudinal axis 105 of outdoor unit 100; however, in other embodiments, the number of coil locator receptacles 140 of base pan 120 may vary.

As shown particularly in FIGS. 5, 6, in some embodiments, each coil locator receptacle 140 comprises an elongated aperture 142 extending entirely through the base pan 120 between upper surface 122 and lower surface 123 and having a generally rounded rectangle cross-section. Additionally, the aperture 142 of each coil locator receptacle 140 comprises a pair of reliefs 144 positioned at opposing longitudinal ends of aperture 142 and extending radially towards the outer lip 130 of base pan 120. Further, each coil locator receptacle 140 may include an elongated tab 146 extending substantially orthogonally from the coil support surface 124 of base pan 120 and comprising a planar outer contact surface 147. Additionally, tab 146 may extend longitudinally between the pair of reliefs 144 of aperture 142 such that a plane 148 (shown in FIG. 6) extending orthogonal to coil support surface 124 may extend through both tab 146 and aperture 142. Further, the tab 146 of each coil locator receptacle 140 may be positioned along a lateral side of aperture 142 proximal outer lip 130 of base pan 120 such that tab 146 is positioned radially between (relative longitudinal axis 105) outer lip 130 and at least a portion of aperture 142.

Referring to FIGS. 1, 3, protective shroud 150 of outdoor unit 100 at least partially surrounds heat exchanger coil 102 to protect coil 102 from the ambient environment surrounding outdoor unit 100 and provide structural strength to the outdoor unit 100. Protective shroud 150, also commonly referred to as a wrapper, may extend longitudinally along longitudinal axis 105 of outdoor unit 100 and may have a first or upper end 151 and a second or lower end 153, opposite upper end 151, supported by the coil support surface 124 of base pan 120. Additionally, at least a portion of the lower end 153 of protective shroud 150 may be positioned adjacent the outer lip 130 of base pan 120. In some embodiments, a plurality of fasteners spaced along the perimeter of base pan 120 may extend through apertures formed in outer lip 130 and protective shroud 150 to couple protective shroud 150 with base pan 120.

Additionally, in some embodiments, shroud 150 may encircle or surround the entire perimeter of heat exchanger coil 102. Shroud 150 may comprise a plurality of angled panels 152, and a control panel 154 upon which a controller of outdoor unit 100 may be mounted. Panels 152, 154 of protective shroud 150 may be coupled together via a plurality of fasteners and at least some of the angled panels 152 may include openings formed therein to allow airflow to pass through protective shroud 150 and flow across the tubing 104 of heat exchanger coil 102. In some embodiments, the protective shroud 150 and/or the base pan 120 may be formed from sheet metal; however, in other embodiments, protective shroud 150 and base pan 120 may be formed from various materials.

Referring to FIGS. 7-13, detailed views of one of the plurality of coil locators 200 of outdoor unit 100 are shown. As shown particularly in FIG. 7, outdoor unit 100 includes four coil locators 200 spaced equidistantly (ninety degrees apart) about the longitudinal axis 105 of outdoor unit 100; however, in other embodiments, the number of coil locators 200 of outdoor unit 100 may vary. Coil locators 200 are configured to couple with the plurality of coil locator receptacles 140 of base pan 120 to secure or lock coil locators 200 with base pan 120 such that relative movement between coil locators 200 and base pan 120 is prevented. As described further below, each coil locator 200 may be secured or locked to base pan 120 such that, once installed, relative movement between the coil locator 200 and the base pan 120 vertically, extending parallel to the longitudinal axis 105 of outdoor unit 100, as well as horizontally (e.g., in horizontal directions extending parallel to orthogonally extending horizontal X and Y axes shown in FIGS. 2, 7), is prevented.

As shown particularly in FIGS. 8-13, each coil locator 200 may have an inner end 201, an outer end 203 opposite the inner end 201, and a pair of opposing lateral sides 205. Each coil locator 200 may comprise a non-metallic, corrosion resistant material. For example, each coil locator 200 may comprise a polymeric material. In some embodiments, each coil locator 200 may comprise a composite material. Each coil locator 200 may comprise a material resistant to ultraviolet (UV) light and/or a fire retardant material.

The coil locator 200 may include a horizontal support member 202 and a vertical support member 204. Horizontal support member 202 may comprise a generally planar horizontal support surface 207 and the vertical support member 204 may comprise a generally planar vertical support surface 209. The coil locator 200 may also include a skirt 206 extending from the horizontal support member 202 to a lower support surface 208 of the coil locator 200. The coil locator 200 may also include a pair of side panels 210 extending from opposing ends of vertical support member 204 to the outer end 203 of the coil locator 200. Additionally, each side panel 210 may extend from the lower support surface 208 of coil locator 200 to an upper surface 212 of coil locator 200. Skirt 206 of the coil locator 200 may extend along a periphery of the horizontal support member 202 to the pair of side panels 210, where each lateral side 205 of coil locator 200 may be defined by one of the side panels 210 and a portion of the skirt 206. As shown particularly in FIG. 11, skirt 206 of the coil locator 200 extends a first non-zero distance 206D between lower support surface 208 and horizontal support surface 207. Additionally, each side panel 210 of the coil locator 200 extends a second non-zero distance 210D between lower support surface 208 and upper surface 212, where second distance 210D may be greater than first distance 206D.

In some embodiments, each coil locator 200 may include a tongue 220 extending both vertically and horizontally from a lower end (opposite upper surface 212) of vertical support member 204 below the lower support surface 208 of coil locator 200. Particularly, the tongue 220 of coil locator 200 may include a pair of lateral sides 221, an inclined portion 222 extending both horizontally and vertically from the lower end of vertical support member 204, and a horizontal portion 224 extending horizontally from the inclined portion 222 to a terminal end 226 of the tongue 220. The inclined portion 222 of tongue 220 may extend at a non-zero angle relative to the lower end of the vertical support member 204. Tongue 220 may vertically extend a third non-zero distance 220D (shown in FIG. 11) below the lower support surface 208 of the coil locator 200. Tongue 220 may also include an upper contact surface 228 which, as will be described further herein, may contact the lower surface 123 of base pan 120 following the assembly of outdoor unit 100. Upper contact surface 228 may overlap a horizontally extending plane 227 (shown in FIG. 11) defined by the lower support surface 208 such that a vertically extending plane 229 (also shown in FIG. 11) may extend through upper contact surface 228 and horizontal plane 227.

Figure 11:
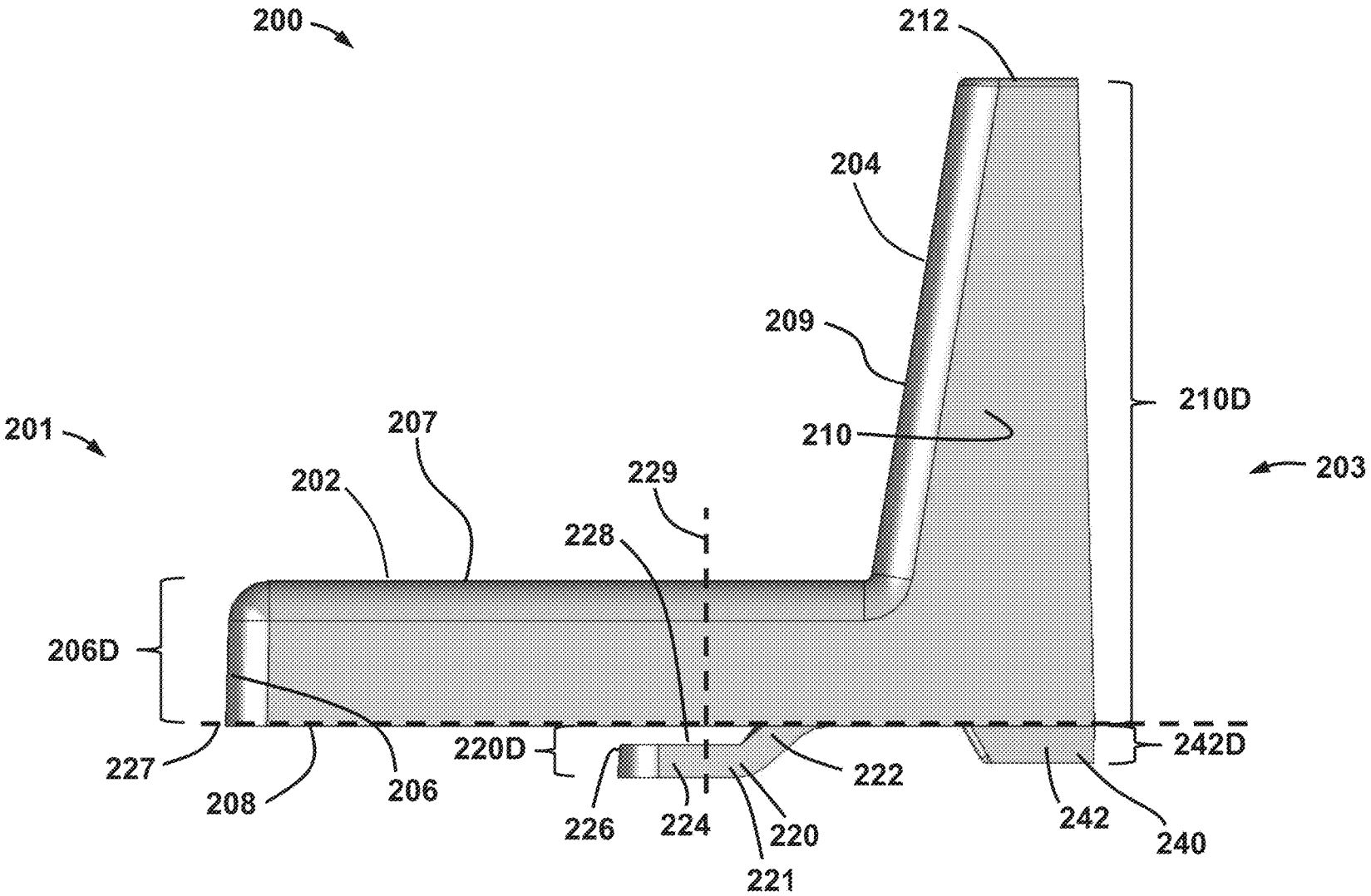
FIG. 11 is a side view of the coil locator of FIG. 8.
Figure 12:
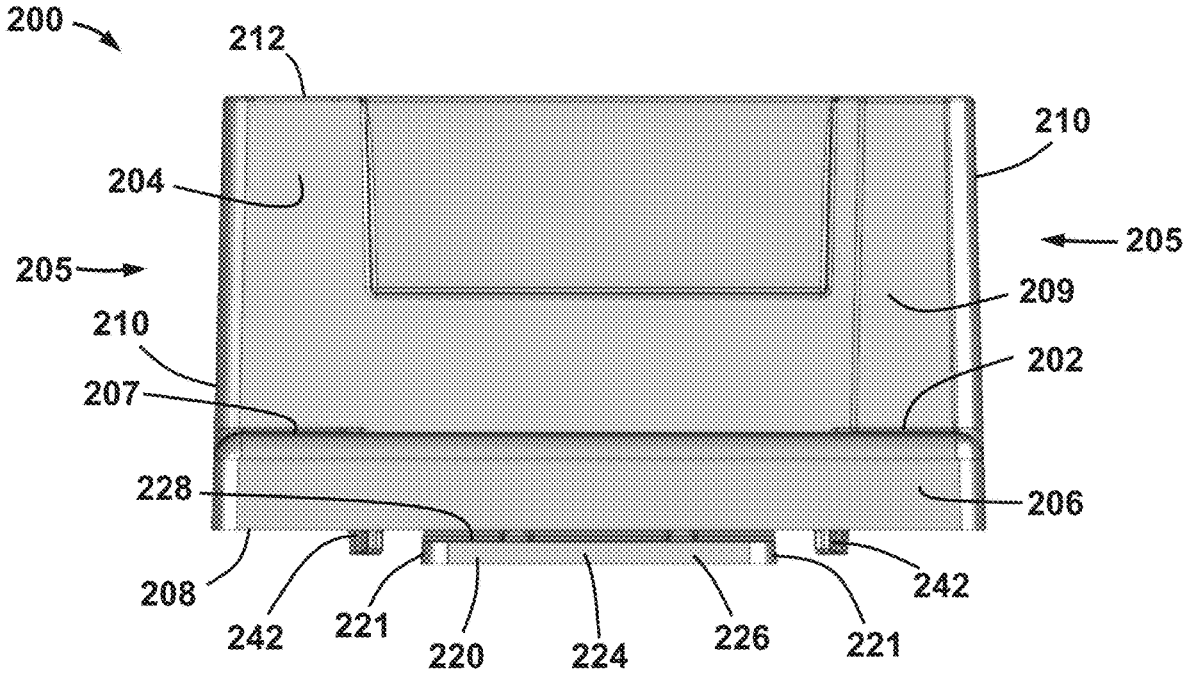
FIG. 12 is a front view of the coil locator of FIG. 8.
Figure 13:
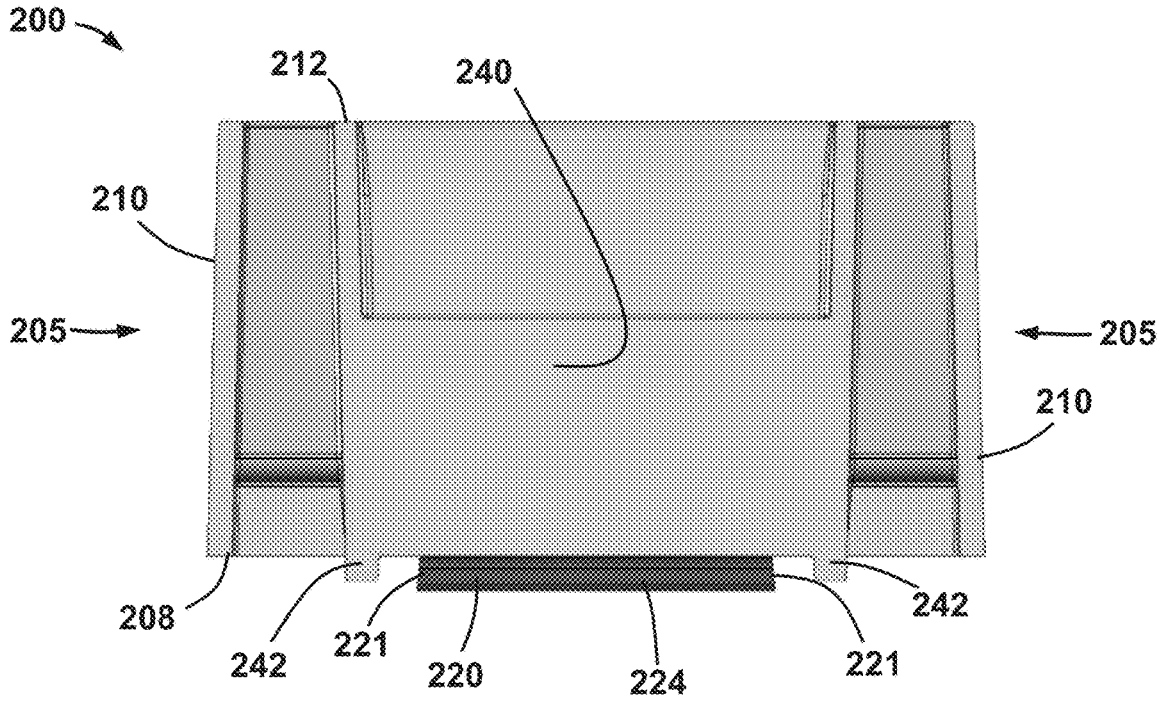
FIG. 13 is a rear view of the coil locator of FIG. 8.

Each coil locator 200 may also include one or more feet 242 each extending fourth non-zero distance 242D (shown in FIG. 11) below the lower support surface 208 of coil locator 200. Particularly, in some embodiments, each coil locator 200 may include a rear member or panel 240 extending from the vertical support member 204 to the outer end 203 of the coil locator 200. The rear panel 240 extends vertically from upper surface 212 to a pair of the feet 242 which are horizontally-spaced and aligned such that a horizontal axis 243 (shown in FIG. 10) extends through each foot 242. In some embodiments, the distance between upper surface 212 and either a lower surface of each foot 242 or a lower surface of tongue 220 may be greater than the distance between the upper surface 212 and the lower support surface 208. Although feet 242 are shown in FIGS. 11-13 extending from rear panel 240, in other embodiments, feet 242 may be positioned at various locations on the coil locator 200. For example, in some embodiments, one or more feet 242 of each coil locator 200 may extend from lower support surface 208 of the coil locator 200.

In some embodiments, a recess 244 (shown in FIG. 10) may extend into rear panel 240 from a lower end of the rear panel 240 proximal feet 242. Recess 244 may include a planar inner contact surface 246 which may extend in a direction substantially orthogonal lower support surface 208 of the coil locator 200. As will be described further herein, the inner contact surface 246 of recess 244 may contact the tab 146 of one of the coil locator receptacles 140 of base pan 120 following the assembly of outdoor unit 100.

Figure 14:
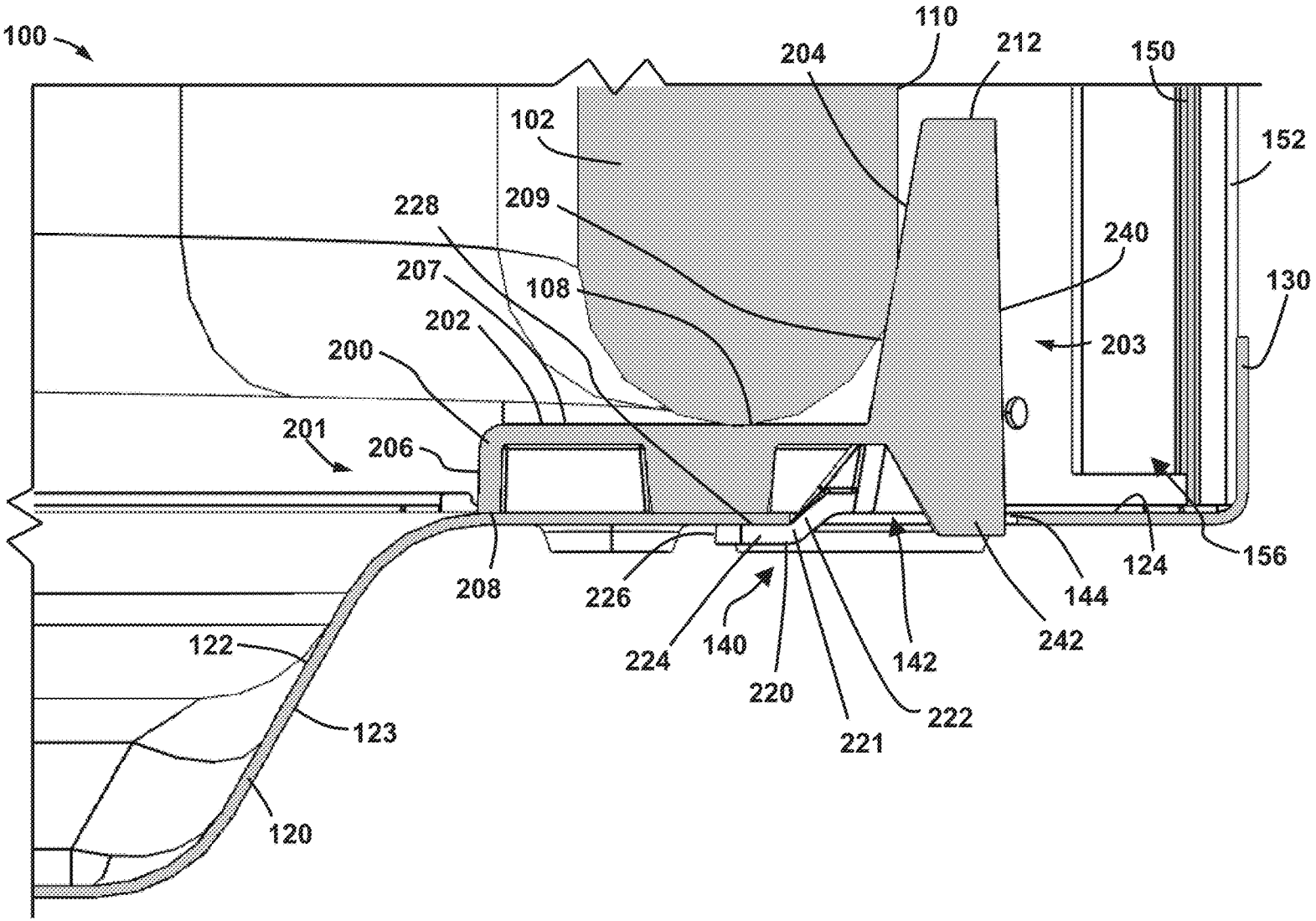
FIG. 14 is a cross-sectional view along line 14-14 in FIG. 3 of the outdoor unit of FIGS. 1, 2.
Figure 15:
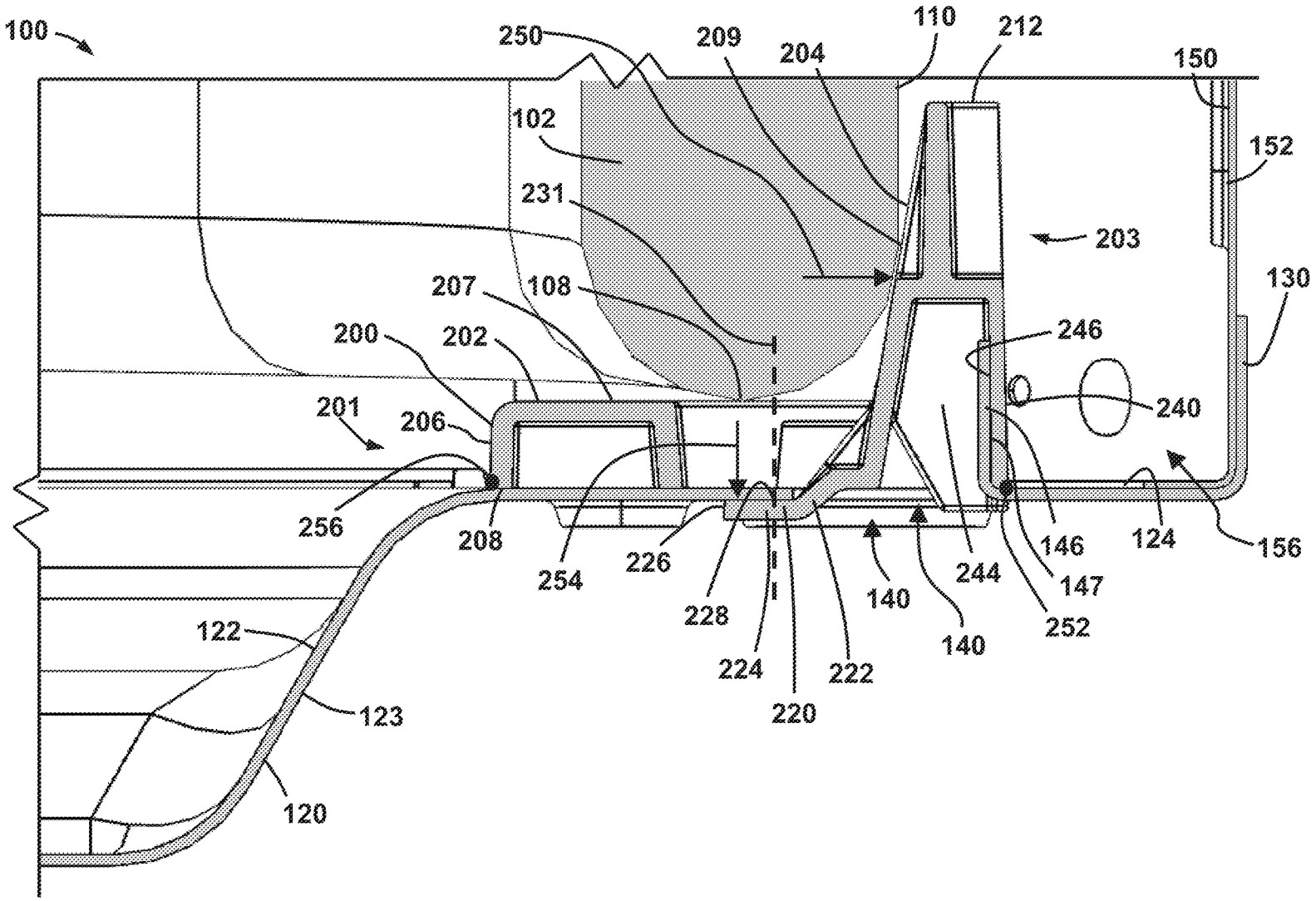
FIG. 15 is a cross-sectional view along line 15-15 in FIG. 3 of the outdoor unit of FIGS. 1, 2.

Referring to FIGS. 14, 15, following assembly of outdoor unit 100, each coil locator 200 may be matingly received in one of the coil locator receptacles 140 of the base pan 120 of outdoor unit 100 such that each coil locator 200 is locked to the base pan 120. Following the assembly of the outdoor unit 100, lower support surface 208 of the coil locator 200 contacts coil support surface 124 of the upper surface 122 of base pan 120. Additionally, tongue 220 of the coil locator 200 extends through aperture 142 of the coil locator receptacle 140 whereby upper contact surface 228 of the tongue 220 of coil locator 200 contacts and is positioned directly beneath the lower surface 123 of the base pan 120 such that a first pivot axis (e.g., axis 231 shown in FIG. 15) extending vertically and orthogonal to horizontal axis 243 and the lower surface 123 of base pan 120 intersects both the lower surface 123 of base pan 120 and the horizontal portion 224 of tongue 220. Contact between lower support surface 208 of coil locator 200 and coil support surface 124 of base pan 120, and contact between upper contact surface 228 of coil locator 200 and lower surface 123 of base pan 120 prevent relative movement between coil locator 200 and base pan 120 in each opposing axial direction along an axis parallel the longitudinal axis 105 of outdoor unit 100.

Additionally, contact between upper contact surface 228 of the coil locator 200 and the lower surface 123 of base pan 120 may prevent the coil locator 200 from "rocking" towards the outer lip 130 of base pan 120 in response to contact between heat exchanger coil 102 and the coil locator 200. For instance, varying forces may be applied to the outdoor unit 100 during transport of outdoor unit 100 to a location where the outdoor unit 100 will be installed (e.g., a home), urging the relatively heavy heat exchanger coil 102 to shift relative other components of outdoor unit 100.

As shown particularly in FIG. 15, contact between heat exchanger coil 102 and the coil locator 200 (e.g., due to movement of outdoor unit 100 during transportation, etc.) may result in the application of a radially outwards (relative longitudinal axis 105 of outdoor unit 100) directed force (indicated by arrow 250 in FIG. 15) from heat exchanger coil 102 against the vertical support surface 209 of coil locator 200. The radially outwards force 250 may apply a torque to coil locator 200, urging the inner end 201 of coil locator 200 to rock or pivot about a second pivot axis 252 (extending out of the page in FIG. 15) in a first rotational direction, where second pivot axis 252 may comprise a lateral axis oriented orthogonal longitudinal axis 105. However, contact between the upper contact surface 228 of coil locator 200 and the lower surface 123 of base pan 120 applies a counter-acting force (indicated by arrow 254 in FIG. 15) to the coil locator 200. The counter-acting force 254 may also apply a torque to coil locator 200, urging the inner end 201 of coil locator 200 to pivot about second pivot axis 252 (shown in FIG. 15) in a second rotational direction opposite the first rotational direction. Thus, the torque resulting from counter-acting force 254 may cancel out the torque applied to coil locator 200 from radially outwards force 250, thereby preventing coil locator 200 from pivoting about second pivot axis 252.

Further, following the assembly of outdoor unit 100, tab 146 of the coil locator receptacle 140 is received in recess 244 of the coil locator 200 and the inner contact surface 246 of coil locator 200 contacts the outer contact surface 147 of tab 146. Further, feet 242 of the coil locator 200 may be received in the reliefs 144 of the aperture 142 of coil locator receptacle 140 whereby coil locator 200 is prevented from pivoting relative base pan 120 about the first pivot axis 231. Contact between the inner contact surface 246 of coil locator 200 and the outer contact surface 147 of tab 146 as well as contact between feet 242 of coil locator 200 and reliefs 144 of the coil locator receptacle 140 may prevent relative movement between the coil locator 200 and the base pan 120 in each opposing axial direction along orthogonal axes parallel with the X and Y axes shown in FIGS. 2, 7.

In some embodiments, a lateral width 242W (shown in FIG. 10) of each foot 242 of the coil locator 200 may be as great, or slightly greater than, a lateral width 144W (shown in FIG. 6) of each relief 144 of the coil locator receptacle 140. In some embodiments, each foot 242 may be configured to flex to reduce the lateral width 144W of the foot 242 as the foot is inserted into a corresponding relief 144 to provide a snap-fit between the foot 242 of the coil locator 200 and the relief 144 of the coil locator receptacle 140. The snap-fit may prevent feet 242 from releasing from the reliefs 144 of coil locator receptacle 140, thereby locking coil locator 200 to the base pan 120. For example, the snap-fit between feet 242 of coil locator 200 and the reliefs 144 of aperture 140 may prevent the outer end 203 of coil locator 200 from pivoting about a second pivot axis 256 (extending out of the page in FIG. 15) in response to a radially directed force applied to coil locator 200. In some embodiments, mechanisms other than a snap-fit between feet 242 and reliefs 144 of receptacle 140 may be employed to lock the coil locator 200 to the base pan 120.

In some embodiments, a space or channel 156 between the outer end 203 of the coil locator 200 and the outer lip 130 of the base pan 120 may be provided in which the lower end of the protective shroud 150 may be positioned. In other words, coil locator 200 is radially spaced (relative longitudinal axis 105 of the outdoor unit 100) from outer lip 130 of base pan 120.

Following the assembly of outdoor unit 100, the lower end 108 of the heat exchanger coil 102 contacts the horizontal support surface 207 of each coil locator 200 of outdoor unit 100 whereby the lower end 108 of the heat exchanger coil 102 is spaced or elevated from the coil support surface 124 of the base pan 120. The lower end 108 of the heat exchanger coil 102 may be vertically spaced (along longitudinal axis 105 of outdoor unit 100) from the base pan 120 by at least the first distance 206D. Thus, heat exchanger coil 102 may be elevated or vertically spaced from any standing moisture collected on coil support surface 124 or any other surface of base pan 120.

Figure 7:
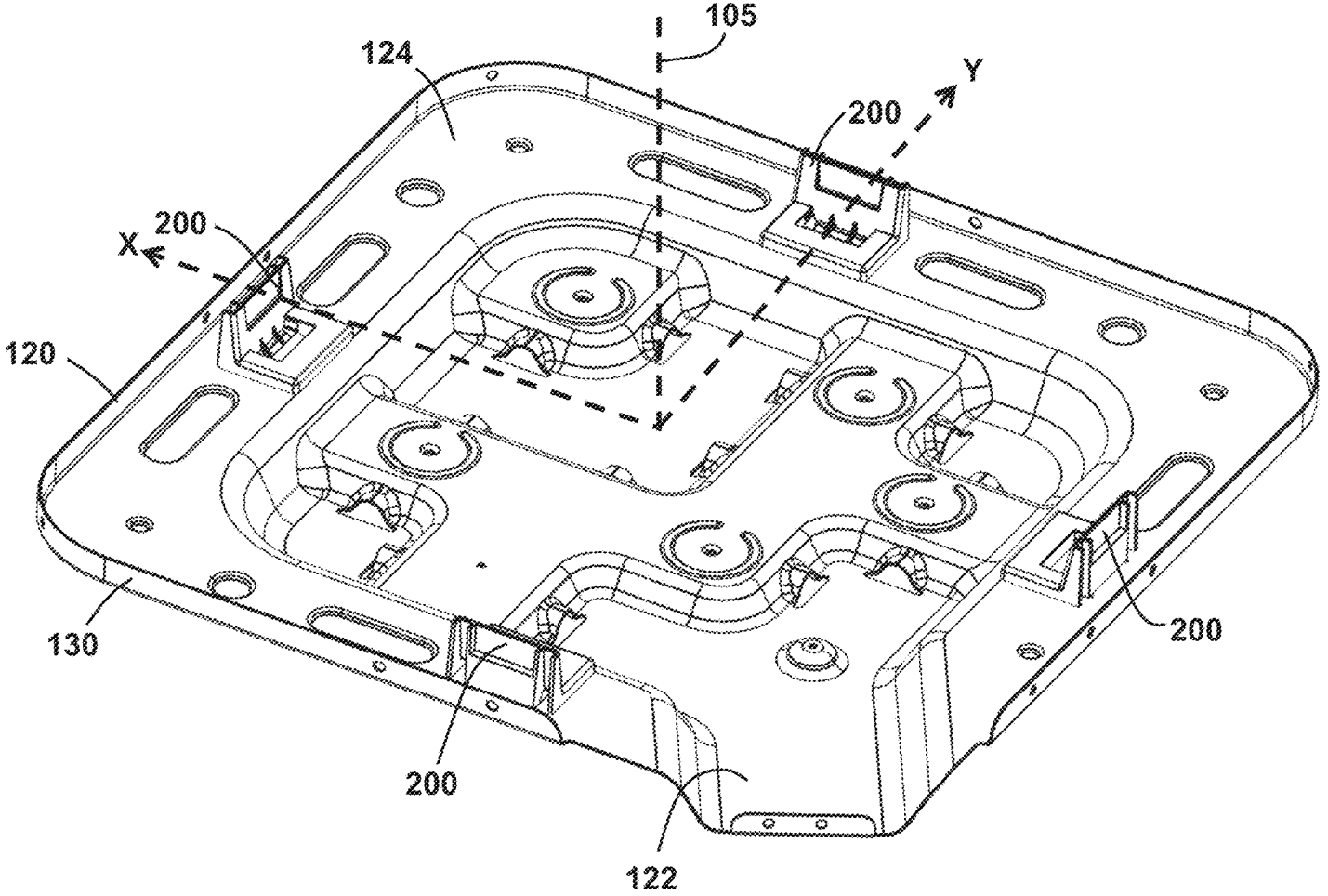
FIG. 7 is a perspective view of the base pan of FIG. 4 and a plurality of coil locators of the outdoor unit of FIGS. 1, 2 according to some embodiments.
Figure 8:
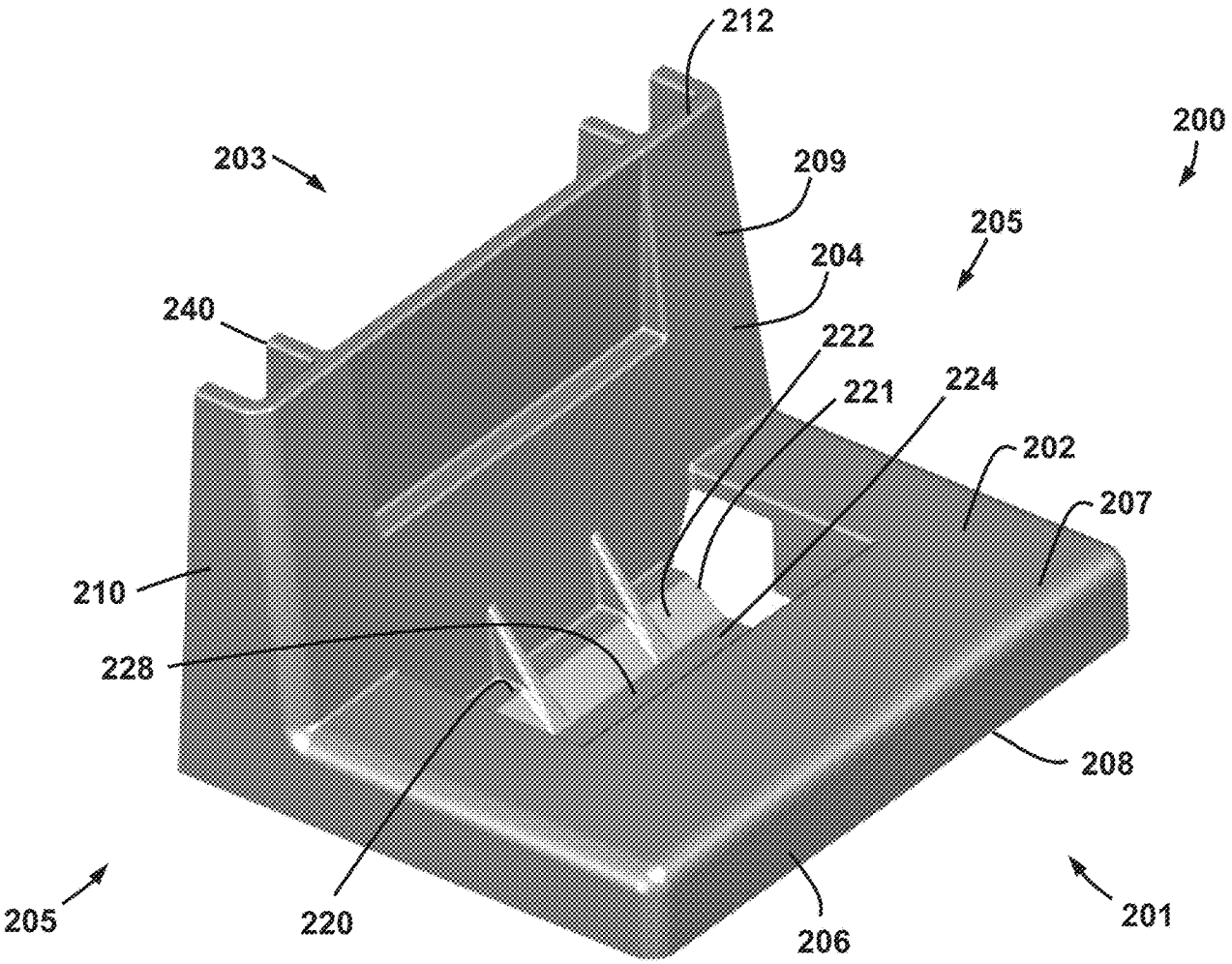
FIG. 8 is a perspective view of one of the coil locators of FIG. 7.
Figure 10:
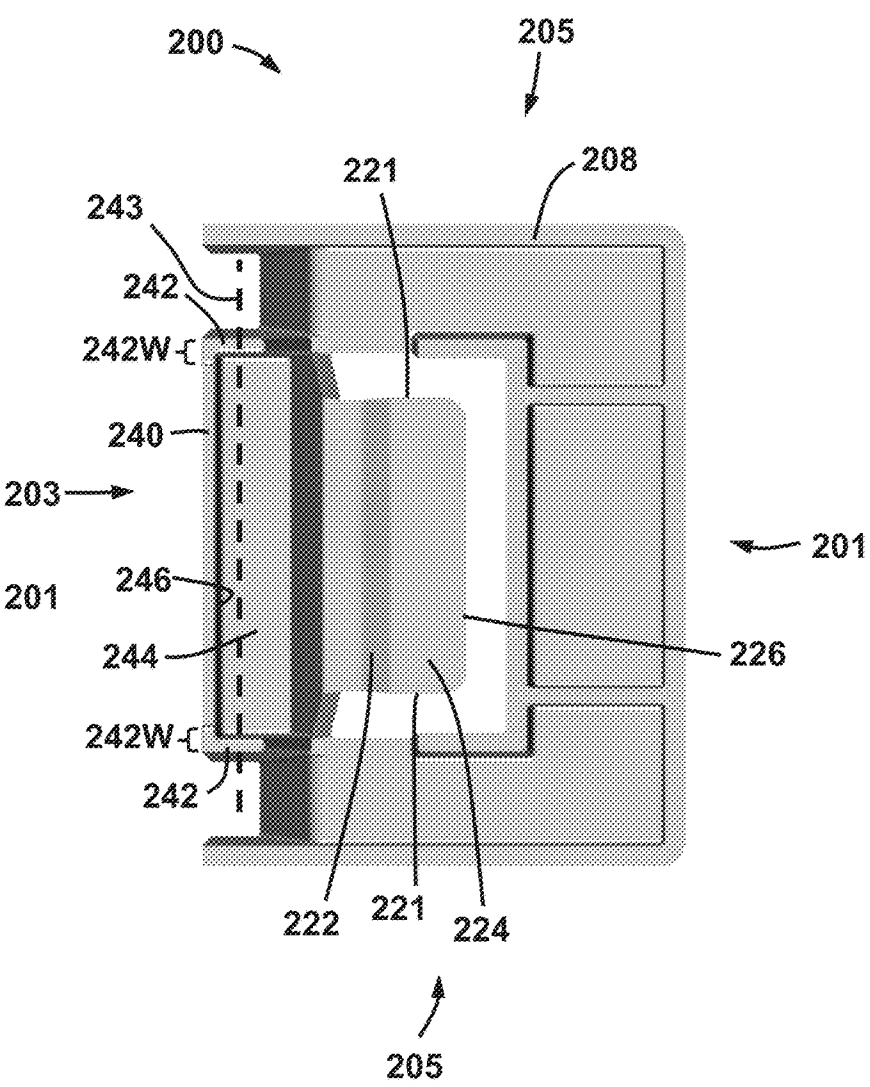
FIG. 10 is a bottom view of the coil locator of FIG. 8.
Figure 9:
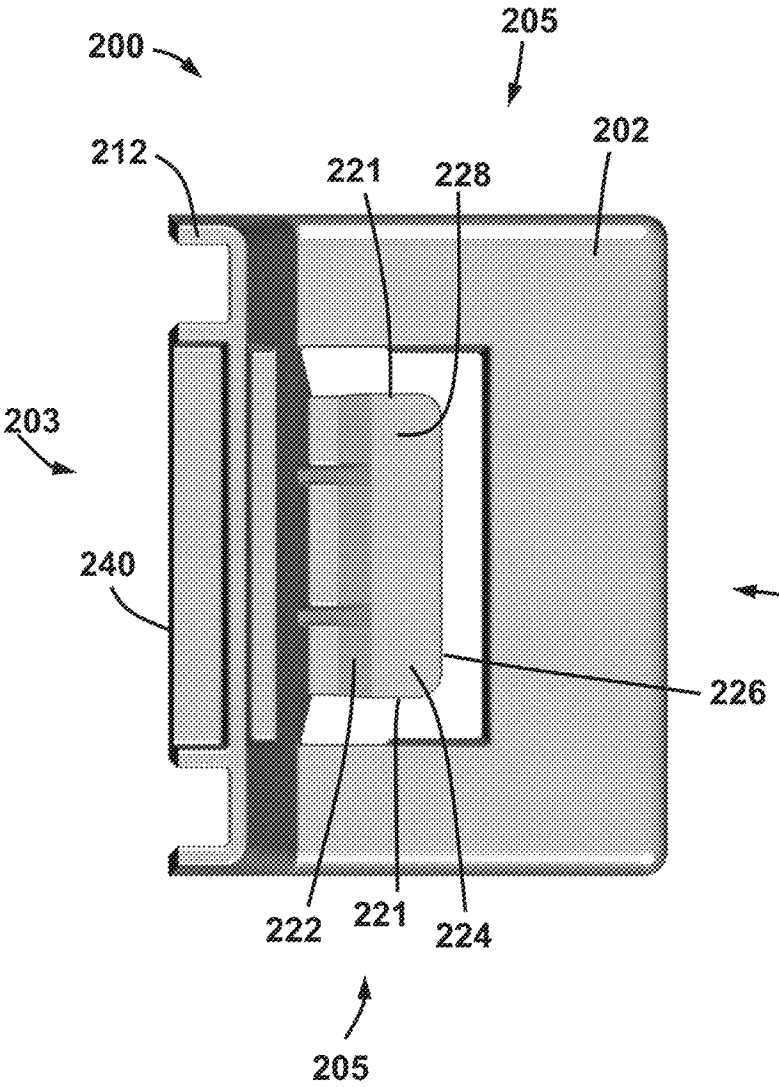
FIG. 9 is a top view of the coil locator of FIG. 8.

Additionally, following the assembly of outdoor unit 100, the radially outer end 110 of heat exchanger coil 102 contacts the vertical support surface 209 of each coil locator 200 of the plurality of coil locators 200, restricting relative movement between the heat exchanger coil 102 and the base pan 120 in each opposing axial direction along the X and Y axes shown in FIGS. 2, 7. Particularly, the heat exchanger coil 102 may be positioned between a first pair of the plurality of coil locators 200 positioned along the X axis shown in FIGS. 2, 7 whereby contact between the vertical support members 204 of the first pair of coil locators 200 and the heat exchanger coil 102 restrict relative movement between the heat exchanger coil 102 and the base pan 120 in each opposing direction along the X axis. Similarly, the heat exchanger coil 102 may be positioned between a second pair of the plurality of coil locators 200 positioned along the Y axis shown in FIGS. 2, 7 whereby contact between the vertical support members 204 of the second pair of coil locators 200 and the heat exchanger coil 102 restrict relative movement between the heat exchanger coil 102 and the base pan 120 in each opposing direction along the Y axis.

Figure 16:
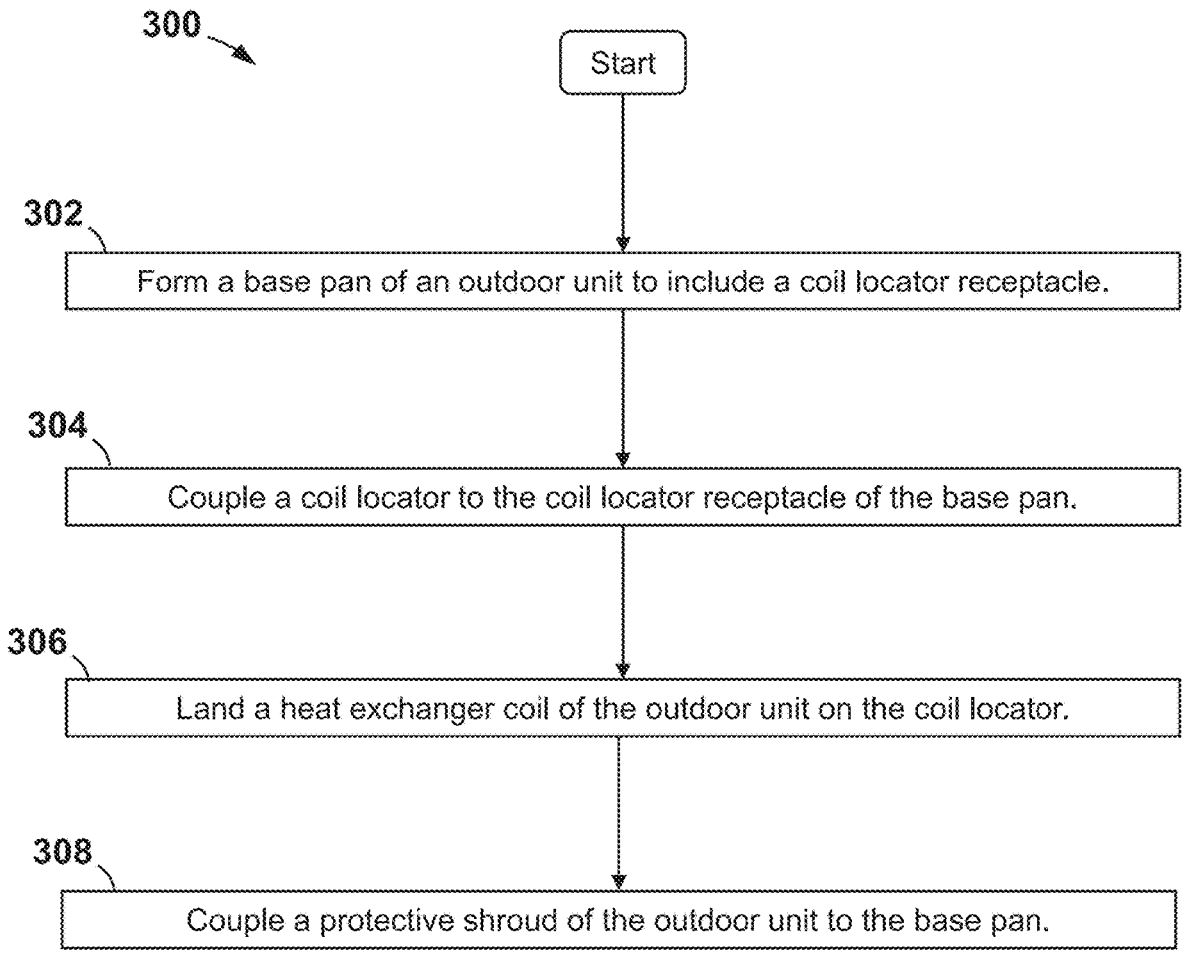
FIG. 16 is a block diagram of a method for assembling a outdoor unit according to some embodiments.

Referring to FIG. 16, a method 300 for assembling an outdoor unit is shown. In some embodiments, method 300 may be practiced with outdoor unit 100 shown in FIGS. 1-15. However, it should be appreciated that embodiments of method 300 may be practiced with other systems, assemblies, and devices other than those described above. One or more of the steps of method 300 may be performed manually by a user of the outdoor unit, such as an assembler of the outdoor unit, an installer of the outdoor unit, a technician equipped to service the outdoor unit, etc.

Initially, method 300 includes forming a base pan of an outdoor unit to include a coil locator receptacle at method block 302. Method block 302 may include forming the base pan to include a plurality of the coil locator receptacles, each coil locator receptacle including an aperture extending entirely through the base pan. The aperture of each coil locator receptacle may comprise a pair of reliefs positioned at opposing longitudinal ends of the aperture and each relief may extend radially towards an outer lip of the base pan. Additionally, each coil locator receptacle of the base pan may also include a tab extending substantially orthogonally from a surface of the base pan. For example, method block 302 may include forming the plurality of coil locator receptacles 140 in base pan 120, where each coil locator receptacle 140 includes aperture 142 and tab 146. In some embodiments, the base pan may be stamped or pressed to include the plurality of coil locator receptacles; however, the base pan may be formed to include the plurality of coil locator receptacles through a variety of manufacturing processes.

Method 300 continues by coupling a coil locator to the coil locator receptacle of the base pan. Method block 304 may include coupling the coil locator to the coil locator receptacle of the base pan whereby the relative movement between the coil locator and the base pan is prevented. For example, method block 304 may include preventing the coil locator 200 from rocking or pivoting about a pivot axis relative the base pan 120. Additionally, method block 304 may include restricting relative movement between the coil locator and the base pan in each opposing direction along three orthogonal axes including a vertical axis and a pair of orthogonal horizontal axes, where the vertical axis may be parallel with a longitudinal axis of the outdoor unit.

Figure 17:
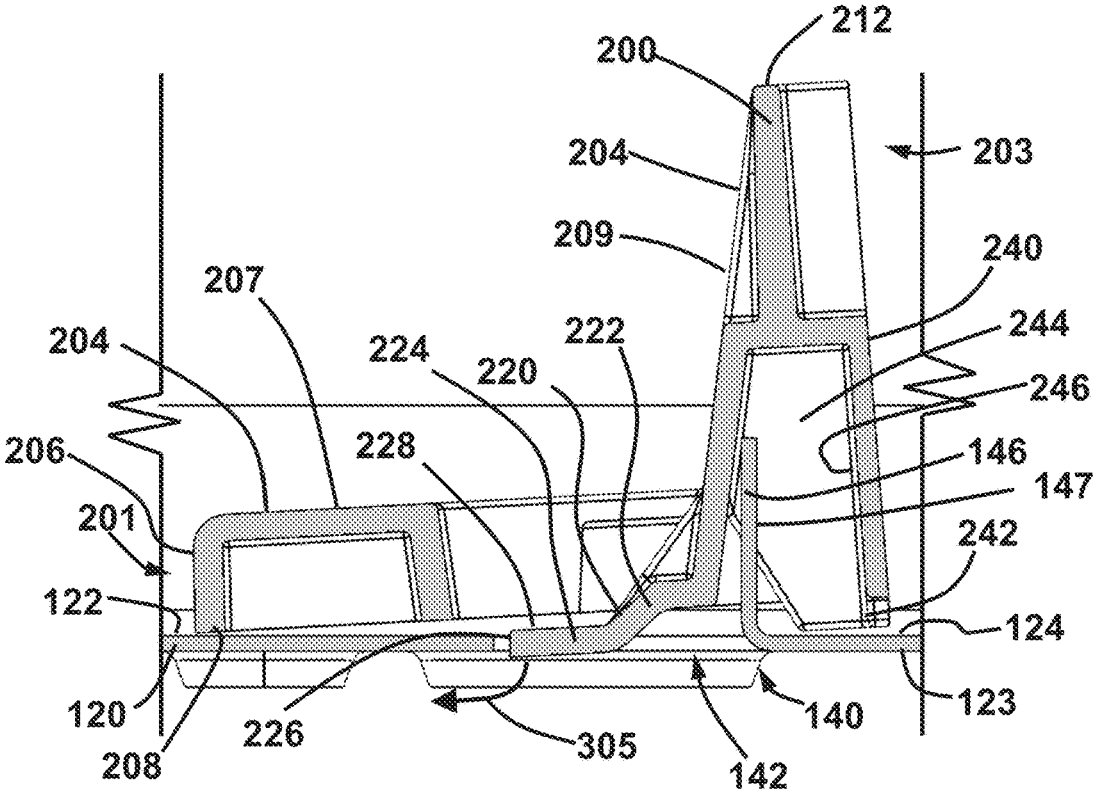
FIGS. 17, 18 are cross-sectional views illustrating the coupling of one of the coil locators of FIG. 7 with the base pan of FIG. 4 according to some embodiments.

Method block 304 may include coupling a plurality of the coil locators to the base pan of the outdoor unit. In some embodiments, method block 304 may include coupling the plurality of coil locators 200 to the base pan 120 of outdoor unit 100 shown in FIGS. 1-15. For example, referring briefly to FIG. 17, first the tab 146 of one of the coil locator receptacles 140 of base pan 120 may be inserted into the recess 244 of one of the coil locators 200. Second, with the tab 146 of the coil locator receptacle 140 received in the recess 244 of the coil locator 200, the tongue 220 of one of the coil locators 200 may be inserted (indicated by arrow 305 in FIG. 17) through the aperture 142 of one of the corresponding coil locator receptacles 140 whereby the upper contact surface 228 contacts and slides against the lower surface 123 of base pan 120 while the lower support surface 208 of the coil locator 200 contacts and slides against the coil support surface 124 of the base pan 120. Once the terminal end 226 of the tongue 220 is inserted through and into the aperture 142 of the coil locator receptacle 140, the coil locator 200 may be displaced radially inwards towards the longitudinal axis 105 of outdoor unit 100 until the outer contact surface 147 of tab 146 contacts or is disposed adjacent the inner contact surface 246 of the coil locator 200, restricting further radially inward travel of coil locator 200 relative to the base pan 120. Contact between upper contact surface 228 of coil locator 200 and the lower surface 123 of base pan 120 may prevent the inner end 201 of coil locator 200 from pivoting about a pivot axis (e.g., first pivot axis 252 shown in FIG. 15) relative base pan 120.

Figure 18:
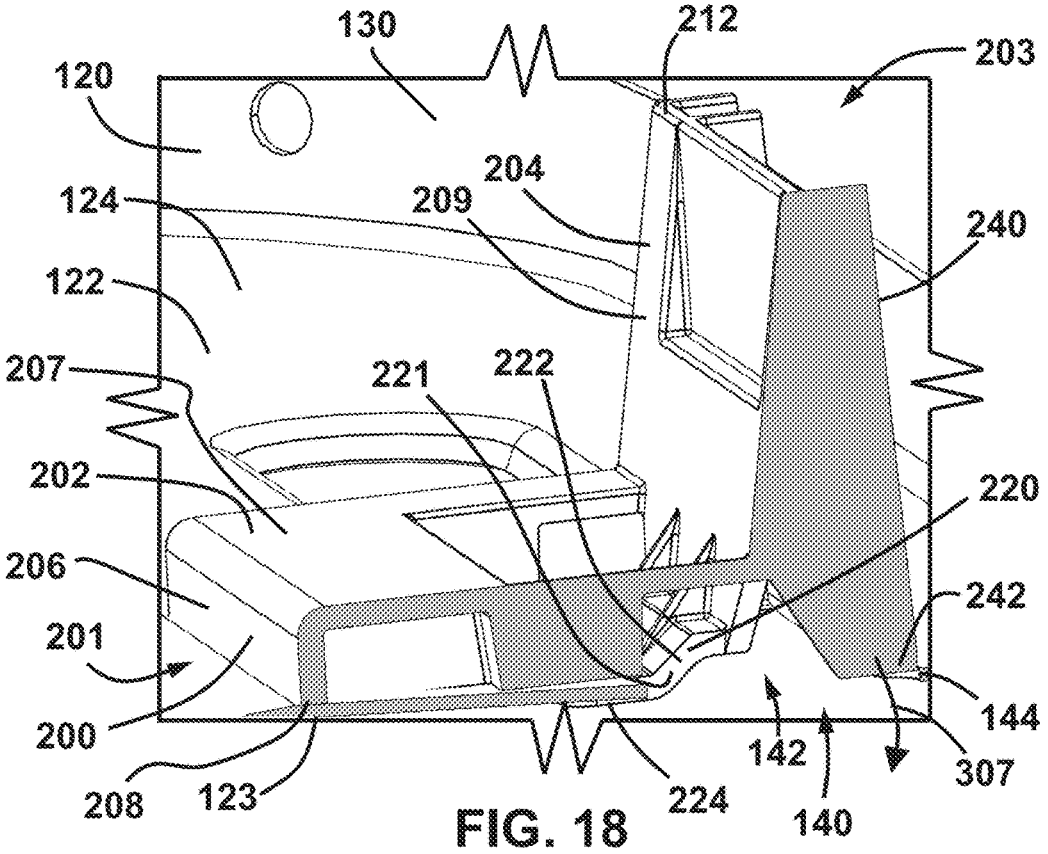

Referring briefly to FIG. 18, following the insertion of the tongue 220 of coil locator 200 through the aperture 142 of the corresponding coil locator receptacle 140, feet 242 of the coil locator 200 may each be inserted into reliefs 144 of the aperture 142 of the coil locator receptacle 140. Particularly, the outer end 203 of the coil locator 200 may be pivoted (indicated by arrow 307 in FIG. 18) towards the coil support surface 124 whereby each foot 242 of the coil locator 200 is inserted into one of the reliefs 144 of the coil locator receptacle 140. In some embodiments, feet 242 of the coil locator 200 may audibly pop or snap into reliefs 144 of the coil locator receptacle 140 to form a snap-fit between the coil locator 200 and the base pan 120. The popping sound made in response to the snapping of the feet 242 of coil locator 200 into the reliefs 144 of coil locator receptacle 140 may provide confirmation to the user/assembler of outdoor unit 100 (e.g., assembler or installer of the outdoor unit, etc.) that the coil locator 200 is locked to the base pan 120. Additionally, the snap-fit formed between feet 242 of coil locator 200 and reliefs 144 of aperture 142 may prevent the outer end 203 of coil locator 200 from pivoting about a pivot axis (e.g., second pivot axis 256 shown in FIG. 15) relative base pan 120.

Referring again to FIG. 16, method 300 continues by lowering a heat exchanger coil of the outdoor unit onto the coil locator at method block 306. Method block 306 may include lowering the heat exchanger coil onto a plurality of the coil locators coupled to the base pan of the outdoor unit. In some embodiments, relative lateral movement between the heat exchanger coil and the base pan may be prevented once the heat exchanger coil is landed on the plurality of coil locators. For instance, relative movement between the heat exchanger coil and the base pan may be prevented in each opposing direction along a pair of lateral axes each extending orthogonal a longitudinal axis of the outdoor unit following the landing of the heat exchanger coil on the plurality of coil locators. Additionally, the heat exchanger coil may be spaced or elevated from the base pan following the lowering of the heat exchanger coil onto the plurality of coil locators. For instance, the lower end of the heat exchanger coil may be vertically spaced from a coil support surface upon which the coil locator is positioned. In this configuration, the coil locator may be positioned vertically between the lower end of the heat exchanger coil and the coil support surface.

In some embodiments, method block 306 may include lowering heat exchanger coil 102 onto the plurality of coil locators 200 of the outdoor unit 100 shown in FIGS. 1-15. For example, heat exchanger coil 102 may be lowered onto the plurality of coil locators 200 whereby the lower end 108 of heat exchanger coil 102 contacts the horizontal support surface 207 of each coil locator 200, restricting further downward travel of the heat exchanger coil 102 relative base pan 120. Additionally, as the heat exchanger coil 102 is lowered onto the plurality of coil locators 200 the radially outer end 110 of the heat exchanger coil 102 may contact the vertical support surface 209 of each coil locator 200, preventing relative movement between heat exchanger coil 102 and the base pan 120 in each opposing direction along a pair of lateral axes (e.g., the X and Y axes shown in FIGS. 2, 7) each extending orthogonal the longitudinal axis 105 of outdoor unit 100. Further, the lower end 108 of the heat exchanger coil 102 may be spaced or elevated from the base pan 120 following the lowering of the heat exchanger coil 102 onto the plurality of coil locators 200. In this manner, the lower end 108 of the heat exchanger coil 102 may be vertically spaced from or elevated above any moisture collected or pooled on surfaces of base pan 120 (e.g., on coil support surface 124).

Method 300 continues by coupling a protective shroud of the outdoor unit to the base pan at method block 308. Method block 308 may include positioning the protective shroud radially (relative to a longitudinal axis of the outdoor unit) between the coil locator and an outer lip of the base pan. For example, method block 308 may include positioning protective shroud 150 in the channel 156 formed between the outer end 203 of each coil locator 200 and outer lip 130 of the base pan 120 of outdoor unit 100. In this position, protective shroud 150 may extend about the entire perimeter of the heat exchanger coil 102 supported by coil locators 200. Method block 308 may additionally include extending one or more fasteners through the outer lip 130 to couple the protective shroud 150 with the base pan 120.

In addition to the method blocks 302-308 described above, method 300 may include additional steps such as, for example, coupling an outdoor fan to the protective shroud and/or other member of the outdoor unit. Method 300 may also include coupling a controller and/or other accessories to the outdoor unit. Additionally, in embodiments where the outdoor unit comprises an outdoor unit of a climate control system, method 300 may include coupling a compressor of the climate control system to the base pan of the outdoor unit.

Figure 19:
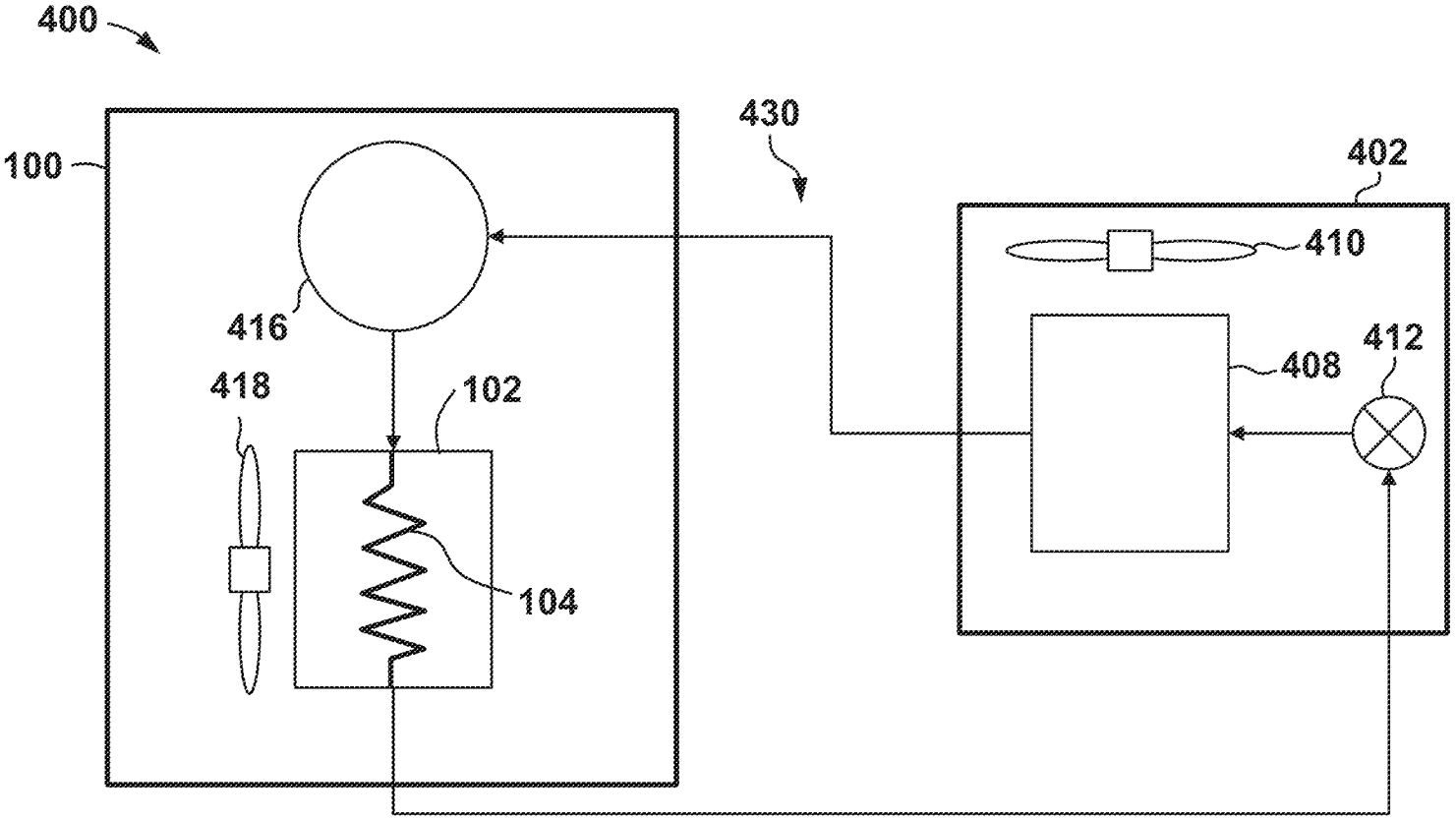
FIG. 19 is a diagram of a climate control system according to some embodiments.

Referring to FIG. 19, a schematic diagram of a climate control system 400 according to some embodiments is shown and which comprises the outdoor unit 100 described above. In this embodiment, climate control system 400 is a vapor compression air conditioning system that is configured to circulate a refrigerant through a refrigerant loop so as to provide a cooling functionality for an indoor space (e.g., such as an interior or a house, office, retail store, etc.). The climate control system 400 generally comprises an indoor unit 402, outdoor unit 100, and a refrigerant loop 430 extending between and through the indoor unit 402 and outdoor unit 100.

Indoor unit 402 generally comprises an indoor air handling unit comprising an indoor heat exchanger 408, an indoor fan 410, and an indoor metering device 412. The indoor heat exchanger 408 may generally be configured to promote heat exchange between refrigerant carried within tubing of the indoor heat exchanger 408 and an airflow (e.g., generated by the indoor fan 410) that may contact the indoor heat exchanger 408 but that is segregated from the refrigerant. In some embodiments, the indoor heat exchanger 408 may comprise a plate-fin heat exchanger; however, in other embodiments, indoor heat exchanger 408 may comprise a microchannel heat exchanger and/or any other suitable type of heat exchanger.

The indoor fan 410 may generally comprise a centrifugal blower comprising a blower housing, a blower impeller at least partially disposed within the blower housing, and a blower motor configured to selectively rotate the blower impeller. The indoor fan 410 may generally be configured to provide airflow through the indoor unit 402 and/or the indoor heat exchanger 408 to promote heat transfer between the airflow and a refrigerant flowing through the indoor heat exchanger 408. The indoor fan 410 may also be configured to deliver temperature-conditioned air from the indoor unit 402 to one or more areas and/or zones of an indoor space. The indoor fan 410 may generally comprise a mixed-flow fan and/or any other suitable type of fan.

The indoor metering device 412 may generally comprise an electronically-controlled motor-driven electronic expansion valve (EEV). In some embodiments, however, the indoor metering device 412 may comprise a thermostatic expansion valve, a capillary tube assembly, and/or any other suitable metering device.

In addition to the heat exchanger coil 102 described above, outdoor unit 100 may comprise a compressor 416, and an outdoor fan 418. As described above, heat exchanger coil 102 may generally be configured to promote heat transfer between a refrigerant carried within the internal tubing 104 of the heat exchanger coil 102 and an airflow that contacts the heat exchanger coil 102 but that is segregated from the refrigerant.

The compressor 416 of outdoor unit 100 may generally comprise a variable speed scroll-type compressor that may generally be configured to selectively pump refrigerant at a plurality of mass flow rates through the indoor unit 402, the outdoor unit 100, and/or between the indoor unit 402 and the outdoor unit 100. In some embodiments, the compressor 416 may comprise a rotary type compressor configured to selectively pump refrigerant at a plurality of mass flow rates. In some embodiments, however, the compressor 416 may comprise a modulating compressor that is capable of operation over a plurality of speed ranges, a reciprocating-type compressor, a single speed compressor, and/or any other suitable refrigerant compressor and/or refrigerant pump. In some embodiments, compressor 416 may be positioned within the central opening 114 (shown in FIGS. 1-3) of heat exchanger coil 102 and mounted to the base pan 120 (shown in FIGS. 1-5) of outdoor unit 100.

The outdoor fan 418 of outdoor unit 100 may generally comprise an axial fan comprising a fan blade assembly and fan motor configured to selectively rotate the fan blade assembly. The outdoor fan 418 may generally be configured to provide airflow through the outdoor unit 100 to promote heat transfer between the airflow and a refrigerant flowing through the indoor heat exchanger 408. The outdoor fan 418 may generally be configured as a modulating and/or variable speed fan capable of being operated at a plurality of speeds over a plurality of speed ranges. In other embodiments, the outdoor fan 418 may comprise a mixed-flow fan, a centrifugal blower, and/or any other suitable type of fan and/or blower, such as a multiple speed fan capable of being operated at a plurality of operating speeds by selectively electrically powering different multiple electromagnetic windings of a motor of the outdoor fan 418. In some embodiments, outdoor fan 418 may be suspended above heat exchanger coil 102 and coupled to the protective shroud 150 (shown in FIG. 1) of outdoor unit 100.

As shown in FIG. 19, during operations of the climate control system 400 refrigerant may be circulated through the refrigerant loop 430 so that heat is generally absorbed by the refrigerant at the indoor heat exchanger 408 and rejected from the refrigerant at the heat exchanger coil 102 of outdoor unit 100. As a result, operation of the climate control system 400 may generally reduce a temperature (and potentially a relative humidity) of an indoor space (not shown). Starting at the compressor 416, the compressor 416 may be operated to compress refrigerant and pump the relatively high temperature and high pressure compressed refrigerant to the heat exchanger coil 102 of outdoor unit 100, where the refrigerant may transfer heat to an airflow that is passed through and/or into contact with the heat exchanger coil 102 by the outdoor fan 418. After exiting the heat exchanger coil 102, the refrigerant may flow to the indoor metering device 412, which may meter the flow of refrigerant through the indoor metering device 412, such that the refrigerant downstream of the indoor metering device 412 is at a lower pressure than the refrigerant upstream of the indoor metering device 412. From the indoor metering device 412, the refrigerant may enter the indoor heat exchanger 408. As the refrigerant is passed through the indoor heat exchanger 408, heat may be transferred to the refrigerant from an airflow that is passed through and/or into contact with the indoor heat exchanger 408 by the indoor fan 410. Refrigerant leaving the indoor heat exchanger 408 may flow to the compressor 416, where the refrigeration cycle may begin again.

Embodiments disclosed herein include coil locators for outdoor units and methods for assembling an outdoor unit of a climate control system. In some embodiments, a coil locator may couple with a receptacle of a base pan of the outdoor unit whereby movement between the coil locator and the base pan is prevented. Particularly, a snap-fit may be formed between the coil locator and the base pan to lock the coil locator with the base pan. Additionally, a tongue of the coil locator may be positioned beneath a lower surface of the base pan whereby an axis extending parallel to a longitudinal axis of the outdoor unit intersects both the base pan and the tongue. By locking the coil locator to the base pan, a heat exchanger coil of the outdoor unit may be lowered onto to the coil locator to positively locate the heat exchanger coil relative to the base pan whereby horizontal movement between the heat exchanger coil and the base pan is prevented.

By locking the coil locator to the base pan upon assembly of the outdoor unit, the coil locator is prevented from becoming dislodged or decoupled from the base pan (thereby permitting relative movement between the heat exchanger coil and the base pan), such as during transportation of the outdoor unit when varying forces may be applied to the heat exchanger coil. In this manner, damage to the heat exchanger coil due to sliding of the coil relative to the base pan (due to dislodging of the coil locator) may be avoided. Further, the coil locator may vertically space or elevate a lower end of the heat exchanger coil from the base pan, thereby vertically spacing the lower end of the heat exchanger coil from any moisture collected or pooled on the base pan.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. An outdoor unit of a climate control system, comprising:

a base pan comprising an upper surface, a lower surface opposite the upper surface, and at least one receptacle, wherein the at least one receptacle comprises an aperture extending entirely through the base pan from the upper surface to the lower surface;

at least one coil locator coupled to the at least one receptacle of the base pan wherein the at least one coil locator comprises a tongue which extends through the aperture, and a pair of horizontally spaced feet separate and distinct from the tongue and which are received in the aperture, wherein the pair of feet are aligned along a horizontal axis which extends through the pair of feet and wherein the pair of feet restrict the at least one coil locator from pivoting about a pivot axis extending vertically and orthogonal to the horizontal axis;

a heat exchanger coil having an upper end and a lower end opposite the upper end, and wherein the lower end of the heat exchanger coil is positioned on the at least one coil locator; and a fan configured to produce an airflow across the heat exchanger coil.

2. The outdoor unit of claim 1, wherein:

the aperture of the at least one receptacle is elongated and comprises a pair of reliefs positioned at longitudinal ends of the aperture and extending towards an outer lip of the base pan which is positioned along an outer perimeter of the base pan; and each foot of the at least one coil locator is received in one of the reliefs of the aperture of the at least one receptacle.

3. The outdoor unit of claim 2, wherein the tongue of the at least one coil locator extends beneath the lower surface of the base pan whereby a vertical axis extending parallel to the pivot axis intersects both the lower surface of the base pan and the tongue.

4. The outdoor unit of claim 3, wherein the at least one receptacle comprises an elongated tab positioned between the pair of reliefs of the receptacle, wherein the tab extends at a non-zero angle from the upper surface of the base pan, and wherein a planar outer surface of the tab contacts a planar inner surface of the at least one coil locator.

5. The outdoor unit of claim 4, wherein the tongue of the at least one coil locator comprises an inclined portion which extends at a non-zero angle relative to the lower surface of the base pan and a horizontal portion which extends parallel to the lower surface of the base pan.

6. The outdoor unit of claim 5, wherein the lower surface of the base pan comprises a planar surface and wherein the horizontal portion of the tongue of the at least one coil locator comprises a planar surface which contacts the lower surface of the base pan.

7. The outdoor unit of claim 5, wherein the horizontal portion of the tongue extends horizontally away from the pair of feet and the outer lip of the base pan.

8. The outdoor unit of claim 2, wherein: the at least one coil locator is spaced from the outer lip of the base pan; and a shroud is positioned on the base pan between the at least one coil locator and the outer lip of the base pan.

9. An outdoor unit of a climate control system, comprising:

a base pan comprising an upper surface, a lower surface opposite the upper surface, and at least one receptacle, wherein the at least one receptacle comprises an aperture extending entirely through the base pan from the upper surface to the lower surface;

at least one coil locator coupled with the receptacle of the base pan, wherein the at least one coil locator comprises a pair of horizontally spaced feet and a tongue separate and distinct from the pair of feet, wherein the tongue extends through the aperture and beneath the lower surface of the base pan whereby a vertical axis extending orthogonal to the lower surface of the base pan and intersects both the lower surface and the tongue;

a heat exchanger coil having an upper end and a lower end opposite the upper end, and wherein the lower end of the heat exchanger coil is positioned on the at least one coil locator; and a fan configured to produce an airflow across the heat exchanger coil.

10. The outdoor unit of claim 9, wherein the tongue of the at least one coil locator comprises an inclined portion which extends at a non-zero angle relative to the lower surface of the base pan and a horizontal portion which extends parallel to the lower surface of the base pan.

11. The outdoor unit of claim 10, wherein the lower surface of the base pan comprises a planar surface and wherein the horizontal portion of the tongue of the at least one coil locator comprises a planar surface which contacts the lower surface of the base pan.

12. The outdoor unit of claim 11, wherein the horizontal portion of the tongue extends horizontally away from the pair of feet and an outer lip of the base pan which is positioned along an outer perimeter of the base pan.

13. The outdoor unit of claim 12, wherein the pair of feet are aligned along a horizontal axis which extends through the pair of feet and wherein the pair of feet restrict the at least one coil locator from pivoting about a pivot axis extending vertically and orthogonal to the horizontal axis.

14. The outdoor unit of claim 13, wherein:

the aperture of the at least one receptacle is elongated and comprises a pair of reliefs positioned at longitudinal ends of the aperture and extending towards the outer lip of the base pan; and each foot of the at least one coil locator is received in one of the reliefs of the aperture of the at least one receptacle.

15. The outdoor unit of claim 14, wherein the at least one receptacle comprises an elongated tab positioned between the pair of reliefs of the at least one receptacle, wherein the tab extends at a non-zero angle from the upper surface of the base pan, and wherein a planar outer surface of the tab contacts a planar inner surface of the at least one coil locator.

16. The outdoor unit of claim 15, wherein each foot of the at least one coil locator is positioned along a lateral side of the at least one coil locator and wherein the tongue is spaced from each lateral side of the at least one coil locator.

17. A method for assembling an outdoor unit of a climate control system, comprising:

(a) contacting an upper surface of a base pan of the outdoor unit with a support surface of a coil locator of the outdoor unit, wherein the coil locator comprises a pair of horizontally spaced feet and a tongue separate and distinct from the pair of feet;

(b) inserting the tongue of the coil locator through an aperture of a receptacle of the base pan and beneath a lower surface of the base pan whereby a vertical axis extending orthogonal to the lower surface intersects both the lower surface and the tongue; and (c) lowering a heat exchanger coil onto the coil locator.

18. The method of claim 17, further comprising:

(d) inserting the pair of feet of the coil locator through a pair of reliefs positioned at longitudinal ends of the aperture and extending towards an outer lip of the base pan positioned along an outer perimeter of the base pan.

19. The method of claim 18, wherein the pair of feet are aligned along a horizontal axis which extends through the pair of feet and wherein the pair of feet restrict the coil locator from pivoting about a pivot axis extending vertically and orthogonal to the horizontal axis.

20. The method of claim 19, further comprising:

(e) contacting a planar outer surface of a tab of the at least one receptacle with a planar inner surface of the coil locator, wherein the tab extends at a non-zero angle relative to the upper surface of the base pan.

* * * * *